US007040077B2

(12) United States Patent
Yasuoka et al.

(10) Patent No.: US 7,040,077 B2
(45) Date of Patent: May 9, 2006

(54) MEDICINE PACKING APPARATUS

(75) Inventors: Keita Yasuoka, Toyonaka (JP); Hiroyasu Hamada, Toyonaka (JP); Toru Tanaka, Toyonaka (JP)

(73) Assignee: Yuyama Mfg. Co. Ltd., Toyonaka (JP)

( * ) Notice: Subject to any disclaimer, the term of this patent is extended or adjusted under 35 U.S.C. 154(b) by 0 days.

(21) Appl. No.: 10/252,413

(22) Filed: Sep. 24, 2002

(65) Prior Publication Data

US 2003/0074868 A1 Apr. 24, 2003

(30) Foreign Application Priority Data

Sep. 28, 2001 (JP) ..... 2001-303159
Dec. 10, 2001 (JP) ..... 2001-376104

(51) Int. Cl.
*B65B 57/00* (2006.01)

(52) U.S. Cl. ..... 53/493

(58) Field of Classification Search ..... 53/52, 53/237, 493

See application file for complete search history.

(56) References Cited

U.S. PATENT DOCUMENTS 5,839,257 A * 11/1998 Soderstrom et al. ..... 53/411
5,852,911 A * 12/1998 Yuyama et al. ..... 53/168
6,073,834 A * 6/2000 Michael et al. ..... 232/43.1
6,108,588 A * 8/2000 McGrady ..... 700/231
6,112,502 A * 9/2000 Frederick et al. ..... 53/411
6,115,996 A * 9/2000 Yuyama et al. ..... 53/411
6,155,025 A * 12/2000 Komiya et al. ..... 53/147
6,212,853 B1 * 4/2001 Yuyama et al. ..... 53/66
6,385,943 B1 * 5/2002 Yuyama et al. ..... 53/131.4
6,397,558 B1 * 6/2002 Yuyama et al. ..... 53/131.4

FOREIGN PATENT DOCUMENTS

JP 60-82130 5/1985
JP 29333837 5/1999

* cited by examiner

*Primary Examiner*—John Paradiso
(74) *Attorney, Agent, or Firm*—Wenderoth, Lind & Ponack, L.L.P.

(57) ABSTRACT

A medicine packing apparatus including a display unit with which a medicine housed state can be easily determined, operatability is made favorable, and prescription data can also be input. The apparatus also includes a plurality of medicine containers (11), which each contain a medicine and is equipped with a medicine identification unit (16). The containers are housed in a medicine housing rack (1). A medicine included in prescription data is fed from the medicine container 11 by medicine feeder (34). The medicine fed from a medicine feeder (34) is packaged by medicine a packing device (3). Medicine data is read from the medicine identification unit (16) of the medicine container (11) by a reader (40), and housing site data of the medicine container (11) and medicine data of a medicine contained in the medicine container (11) are stored. An arrangement screen including an arrangement view of the medicine containers (11) corresponding to medicine names is displayed in display (4), based on data stored in the memory (64).

15 Claims, 33 Drawing Sheets

Fig. 2
(A)
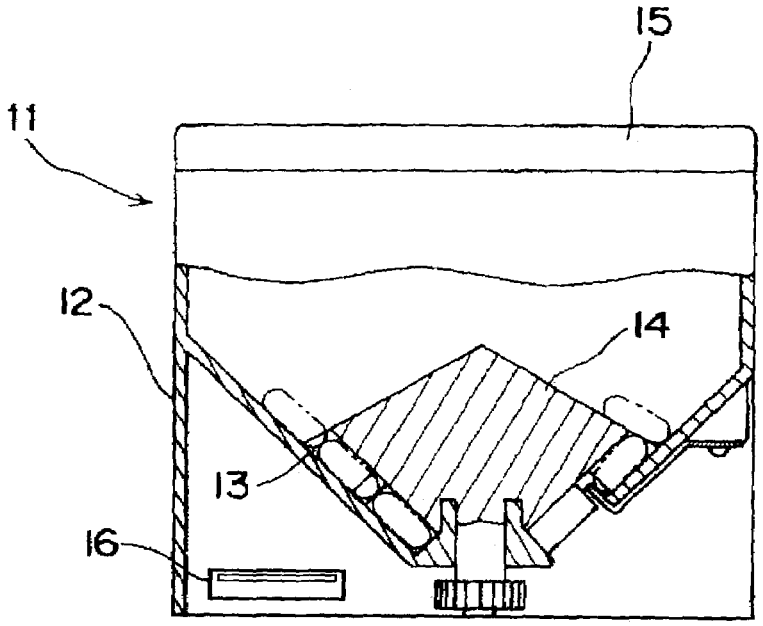
(B)
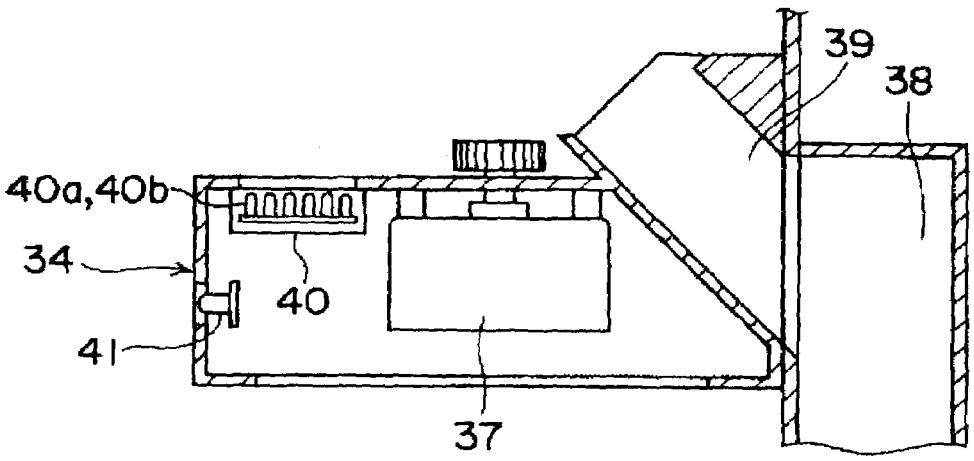

Fig. 32

Tablet cassette selection

| | | | | | | | |
|---|---|---|---|---|---|---|---|
| Seven E/P capsule | Gefanil capsule | Vitamedin | | Proheparum | Sulcain tablet | Amelachite tablet | |
| Flumezin | Atarax P | Phelloberin A | 25 mg Alinamin F sugar-coated tablet | Esperan | Hiberna | Pyrethia tablet | Hustazol |
| Onealfa tablet0.5 | (JP Pharma-copoeia) Warfarin tablet 1 mg | Vasolan tablet | Wypax tablet 0.5 | Wytens tablet | Longes tablet 10 mg | Lorelco | Lorcam tablet 4 mg |
| Loramet tablet 1.0 | Lopemin capsule | Lopresor tablet 20 mg | Rohypnol tablet 2 | Loxonin tablet | Lowgan tablet 10 mg | Rocaltrol capsule 0.25 | Leucon tablet |
| Lendormin tablet | Relifen tablet | Renivace tablet 5 | Renivace tablet 2.5 | Lectisol tablet 25 mg | Lexotan tablet 5 | Lexotan tablet 2 | Regalen capsule |
| Temporary 1 | Temporary 2 | Temporary 3 | Temporary 4 | Temporary 5 | | | |

Decision

Back

MEDICINE PACKING APPARATUS

BACKGROUND OF THE INVENTION

The present invention relates to a medicine packing apparatus.

Conventionally, there is provided a medicine packing apparatus including a display unit that displays a medicine name, patient name, prescription number, prescription date, number of tablets, number of packages and so forth (for example, Japanese Patent Laid-open Publication (Kokai) No. 60-82130 and Japanese Patent Publication No. 2933837).

In this medicine packing apparatus, however, since only character data such as a medicine name is displayed on a screen, it is difficult to grasp which medicine is to be contained in which medicine container and at which position the medicine container is located. Furthermore, there is provided only one kind of method using a keyboard to input prescription data.

SUMMARY OF THE INVENTION

Accordingly, an object of the present invention is to provide a medicine packing apparatus including a display unit with which a medicine contained state can be grasped at one glance, operatability is made favorable and prescription data can be inputted.

The present invention, comprising:

a medicine housing rack for housing a plurality of medicine containers each containing a medicine and equipped with a medicine identification unit, medicine feeding means for feeding a medicine included in prescription data from the medicine container, medicine packing means for packing the medicine fed from the medicine feeding means, reading means for reading medicine data from the medicine identification unit of the medicine container, housing site searching means for searching a housing site of the medicine container, memory means for storing the medicine data read by the reading means and the housing site searched by the housing site searching means, and display means for displaying an arrangement screen in which medicine names are assigned to a plurality of regions corresponding to arrangement of the medicine containers based on the medicine data and the housing sites stored in the memory means.

With this constitution, which medicine is contained in a medicine container at which site can be grasped at one glance from the arrangement screen. Since a medicine name is displayed in a relevant region on the arrangement screen by allowing the reading means to read the medicine data from the medicine identification unit, incorrect display is prevented, and the medicine can be reliably checked.

Preferably, by operating a region in which a medicine name is displayed while the arrangement screen is being displayed in the display means, a medicine number input screen can be displayed separately from the arrangement screen, and dosage regimen data consisting of medicine taking time and doses can be inputted by operations on the medicine number input screen. Consequently, whether a medicine container containing a medicine to be actually fed is set can be judged before packing is started.

Preferably, the memory means stores prescribed prescription data and when prescription data of a patient is identical to prescription data stored in the memory means, the prescription data stored in the memory means can be reused. Consequently, input is saved, and hence efficient processing can be achieved.

Preferably, a message that taking the medicine taking time that is not included in dosage regimen data cannot be inputted is displayed on the tablet number input screen displayed in the display means. Consequently, an input error can be prevented.

Preferably, whether a medicine container is mounted on or dismounted from the medicine housing rack is detected by the housing site searching means, and the display means displays or deletes a medicine name of a relevant region corresponding to the medicine container. Consequently, mounting or dismounting (removal) of the medicine container can be correctly grasped.

Preferably, when a medicine container containing a relevant medicine cannot be detected by the housing site searching means, the display means displays other medicine names that can be selected separately from the arrangement screen. Consequently, medicines that can be substituted can be easily grasped.

Preferably, when a plurality of medicine data having the same dosage regimen pattern are included in prescription data, all regions corresponding to medicine containers containing relevant medicines are displayed on the arrangement screen displayed in the display means so that these regions can be distinguished from other regions, and the same dosage regimen pattern can be changed at once by a Tablet Number Input key displayed separately from the arrangement screen. Consequently, operatability can be further improved.

Preferably, when a medicine container is mounted on and removed from the medicine housing rack, the arrangement screen is displayed in the display means by priority. Consequently, labor for an operation is relieved.

Preferably, a warning can be displayed in the display means based on a medicine use expiration date calculated from medicine data stored in the memory means.

Preferably, all regions corresponding to unpacked medicines included in prescription data can be highlighted in the display means. Consequently, a substitutable medicine container can be easily specified.

Preferably, a substituted medicine container storage rack is included separately from the medicine housing rack, and substitutable sites of medicine containers housed in the medicine housing rack except for those containing unpacked medicines included in the prescription data are displayed in the display means successively from the one closest to the substituted medicine container storage rack. Consequently, operatability at the time of replacement of medicine containers can be improved.

Preferably, the medicine housing rack has a fixed region in which housing sites are set beforehand according to the kinds of medicines contained in a medicine container, and, when a medicine container containing a medicine that is not set beforehand at any housing site in the fixed region is mounted, an error indication is displayed in the display means. Consequently, incorrect mounting can be prevented.

Preferably, when a medicine container is removed from the medicine housing rack during packing, the arrangement screen is displayed in the display means, and a medicine name in a relevant region on the arrangement screen is not displayed. Consequently, which medicine container is removed can be correctly grasped on the screen.

Preferably, when medicines that are currently being packed are contained in a medicine container dismounted from the medicine housing rack, an error indication is displayed separately from the arrangement screen. Consequently, a medicine container can be mounted or dismounted during packing without affecting the packing work.

Preferably, when a housing site of a medicine container is changed, a housing site of the medicine container is re-searched by the housing site searching means, and a searching result is re-displayed as an arrangement screen in the display means. Consequently, input work can be saved.

Preferably, the arrangement screen displayed in the display means is a setup screen for setting a medicine container that can be mounted on each housing site in the medicine housing rack. Consequently, operatability is improved, and setup work can be performed in a short time.

BRIEF DESCRIPTION OF THE DRAWINGS

Other objects and features of the present invention will become clear from the following detail description with reference to the accompanying drawings in which:

FIG. 2(A) is a cross sectional view showing a tablet cartridge and a tablet housing rack and FIG. 2(B) is a cross sectional view showing a tablet feeder;

FIG. 32 is a view showing an arrangement screen according to another embodiment;

FIG. 34 is a view showing a mounting instruction screen of a temporary medicine container that pops up on the arrangement screen in FIG. 32.

DETAILED DESCRIPTION OF THE PREFERRED EMBODIMENTS

Figure 1:
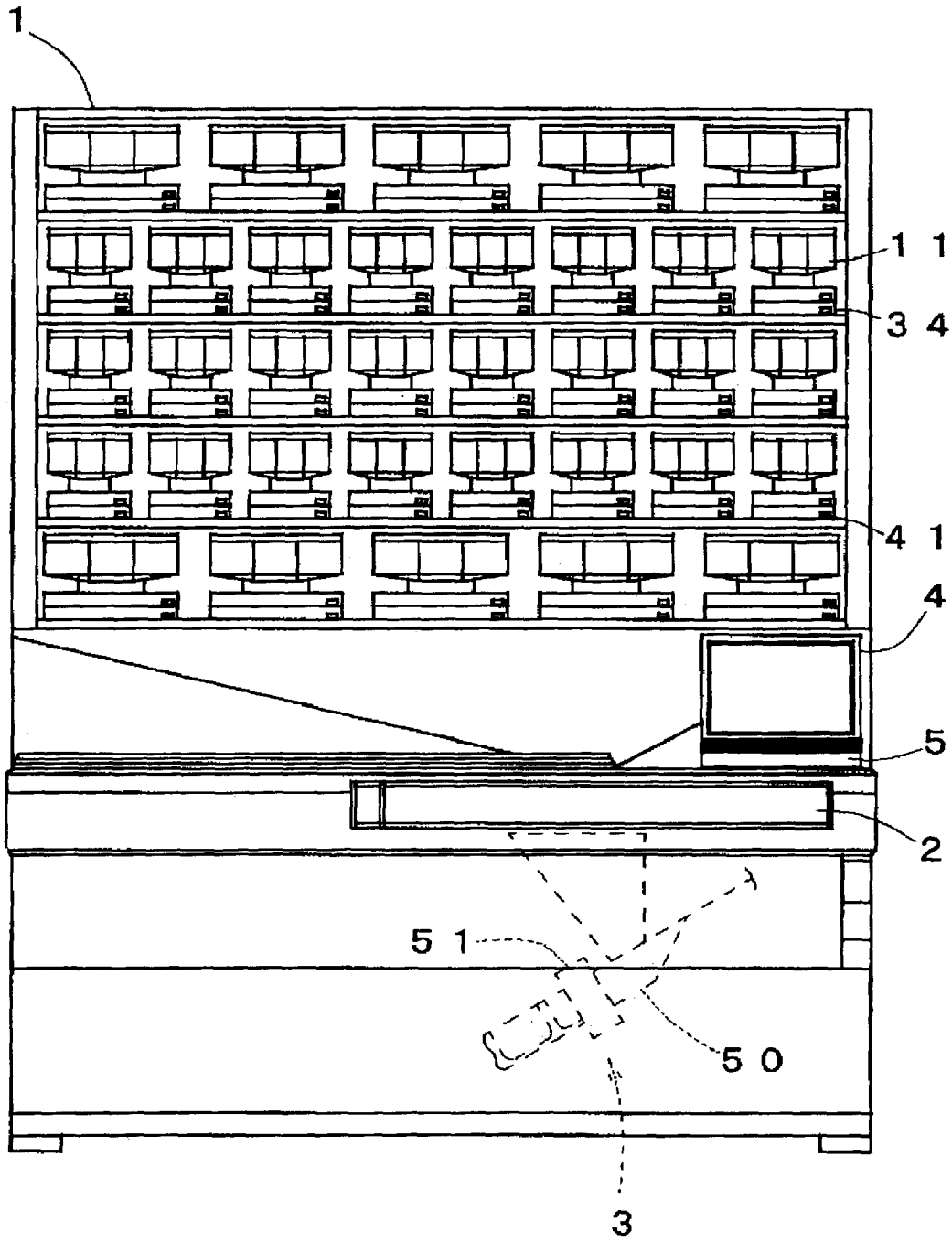
FIG. 1 is a front view showing a first example of a medicine packing apparatus according to the present invention.

FIG. 1 shows a medicine packing apparatus according to the present invention. This medicine packing apparatus includes a tablet housing rack 1, powder processing unit 2, packing device 3, display unit 4 and control unit 5.

The tablet housing rack 1 has a plurality of tablet feeders 34 in a matrix, and a multiplicity of tablet cartridges 11 as an example of a medicine container that can be mounted thereto or dismounted therefrom.

Figure 3:
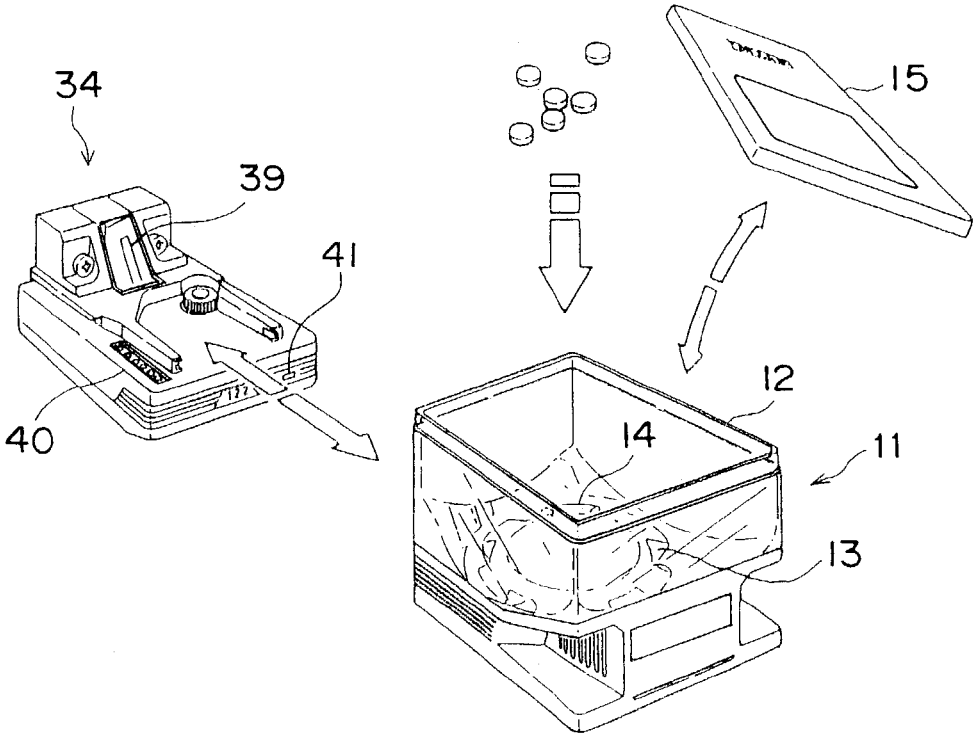
FIG. 3 is a perspective view of the tablet cartridge and the tablet feeder.
Figure 4:
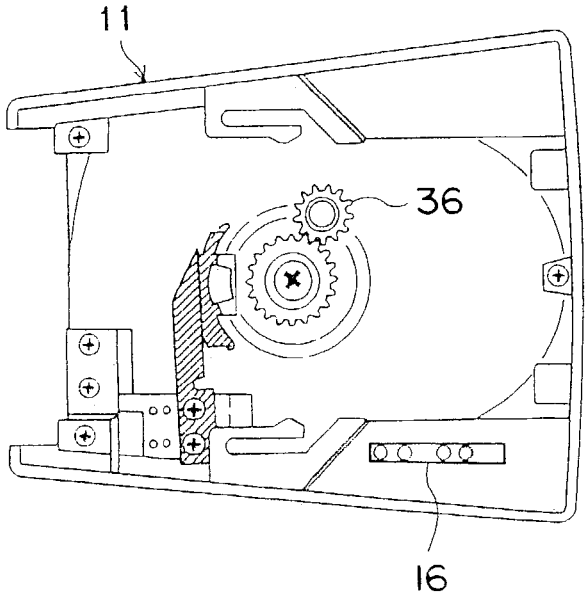
FIG. 4 is a bottom view showing the tablet cartridge.

As shown in FIGS. 2 and 3, each tablet cartridge 11 is constituted by a case 12 having a bowl-like bottom for containing a tablet, a rotor 14, which is rotatably attached to the bottom of the case 12 and has a plurality of tablet pockets 13 in its outer periphery, and a lid body 15 for removably closing the case 12. Furthermore, as shown in FIGS. 2 and 4, the tablet cartridge 11 is equipped with a medicine identification unit 16 for identifying a tablet contained inside. The medicine identification unit 16 is constituted by a reflecting plate, which has a portion that reflects light from each light-emitting device 40*a* of a reader 40 of the tablet feeder 34 and a portion that does not reflect the light (shown with ○ in FIG. 4) to identify a tablet.

As shown in FIG. 2(B), the tablet feeder 34 is equipped with a drive motor 37 connected to a shaft of the rotor 14 of the tablet cartridge 11 via a gear 36 when a tablet cartridge 11 is mounted and a chute 39 for guiding a tablet discharged from the tablet cartridge 11 to a central passage 38.

Furthermore, each tablet feeder 34 includes a reader 40, which is reading means according to the present invention, and a display lamp 41, which is a mounting site display means according to the present invention. The reader 40 is disposed at a position corresponding to the medicine identification unit 16 of the tablet cartridge 11 and reads tablet data from the medicine identification unit 16. The reader 40 is composed of a plurality of units each formed by integrating a light-emitting device 40*a*, which emits light to the reflecting plate of the medicine identification unit 16 of the tablet cartridge 11 when the tablet cartridge 11 is mounted on the tablet feeder 34, and a light-receiving device 40*b*, which receives light reflected on the reflecting plate.

Housing sites in the tablet housing rack 1 are divided into a fixed region of a plurality of stages on an upper side (four stages FIG. 1) and a free region at the lowermost stage. Tablet cartridges 11 containing frequently used medicines are mounted in the fixed region. Therefore, the kinds of tablet cartridges 11 mounted on housing sites in the fixed region are rarely changed. Tablet cartridges 11 containing less frequently used medicines such as special medicines are mounted in the free region.

Figure 30:
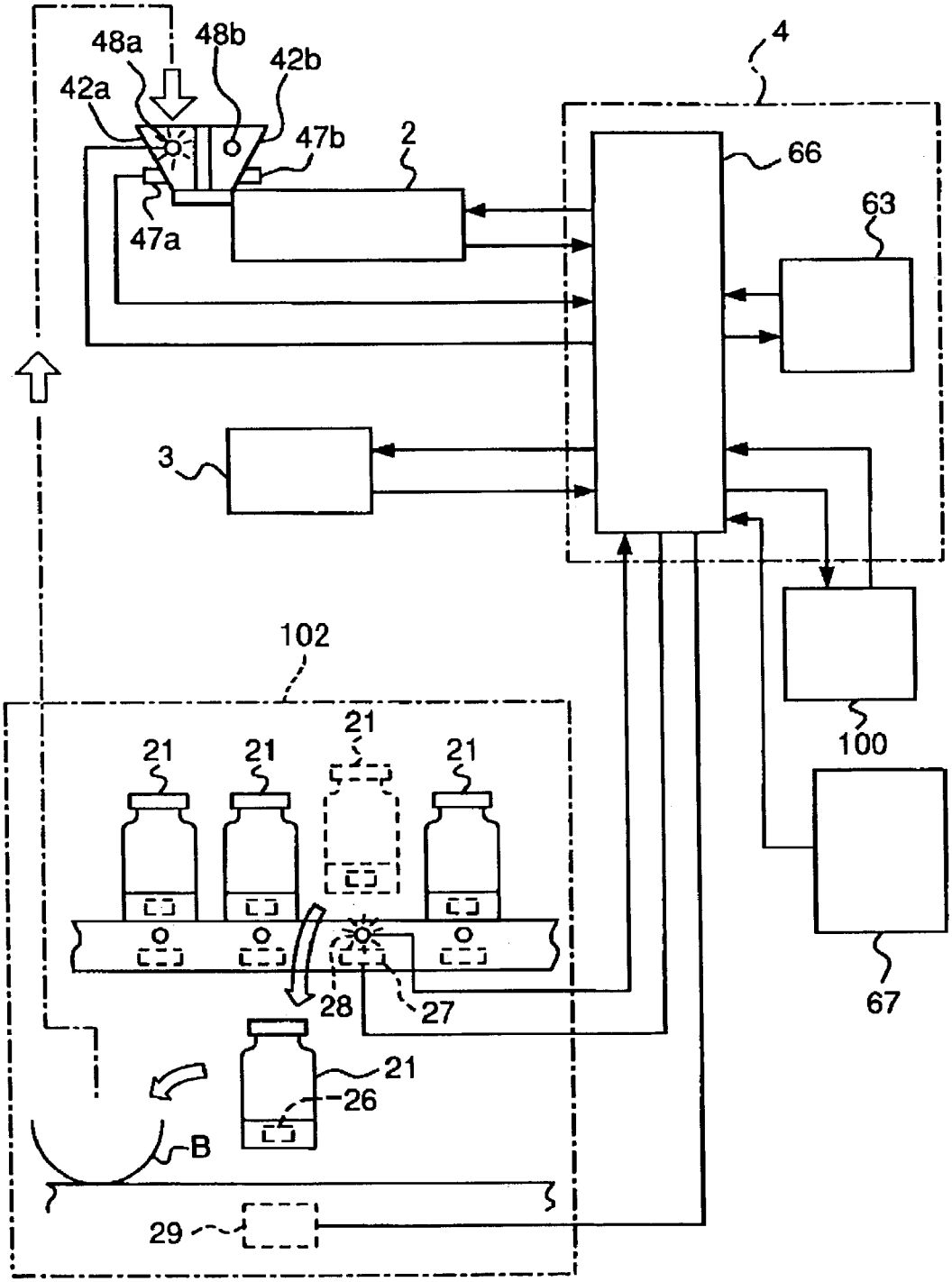
FIG. 30 is a block diagram showing a powder processing operation.

The powder processing unit 2 has a conventionally known constitution such as a type in which a powder is equally contained in circular grooves formed in the outer periphery of a distribution tray and scraped for each packet. This powder processing unit 2 is equipped with two input hoppers 42*a*, 42*b* for inputting a medicine from a powder bottle 21 as shown in FIG. 30. The input hopper 42*a*, 42*b* includes a sensor 47*a*, 47*b* for detecting existence of the powder and a lamp 48*a*, 48*b*, which lights when the powder exists. Each powder bottle 21 has a medicine identification unit 26 at its bottom. The powder bottle 21 is stored in a powder storage rack 102 disposed separately from the tablet housing rack 1. The powder storage rack 102 has a reader 28, which reads the medicine identification unit 26 of the powder bottle 21, and a display lamp 27, which lights when a required powder bottle 21 is searched by the control unit 4. The powder bottle 21 is taken out from the powder storage rack 102 by a pharmacist and inspected by a medicine inspecting device 29. The powder of the powder bottle 21 is prepared according to a prescription and transferred to a prescription container B. The powder in the prescription container B is inputted into the input hopper 42*a*, 42*b*, divided for each packet by the powder processing unit 2 and packaged by the packing device 3.

As shown in FIG. 1, the packing device 3 has a conventionally known constitution that a packing sheet 50 is folded into half in a longitudinal direction, and a fed tablet and/or powder for each pack is inputted, packaged by a heat sealing device 51 and discharged to the outside.

Figure 5:
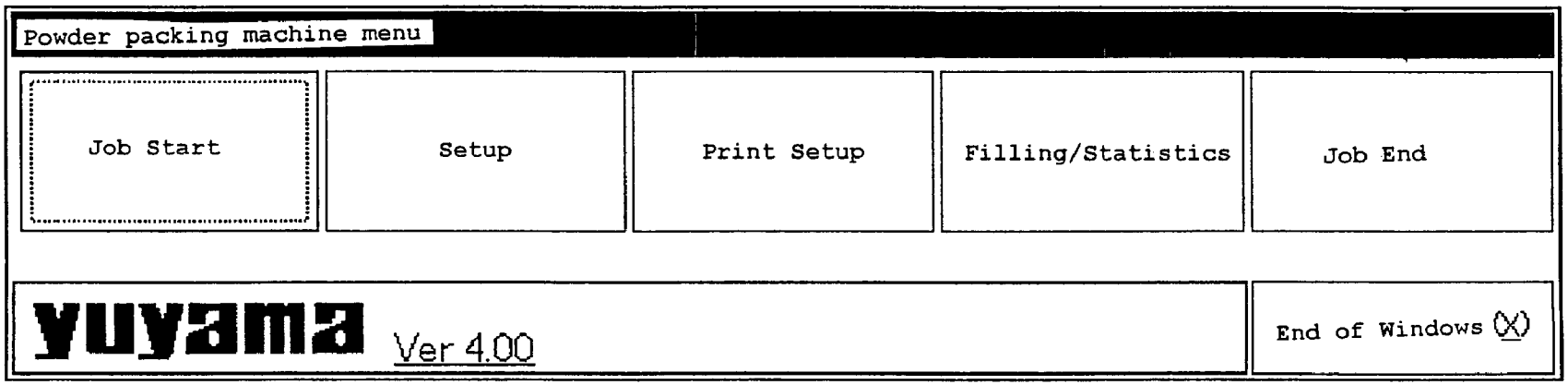
FIG. 5 is a view showing a menu screen.

The display unit 4 is constituted by, for example, a touch panel. As shown in FIG. 5, a menu screen constituted by a Job Start key, Setup key, Print Setup key, Filling/Statistics key and Job-End key is displayed on an initial screen.

Figure 6:
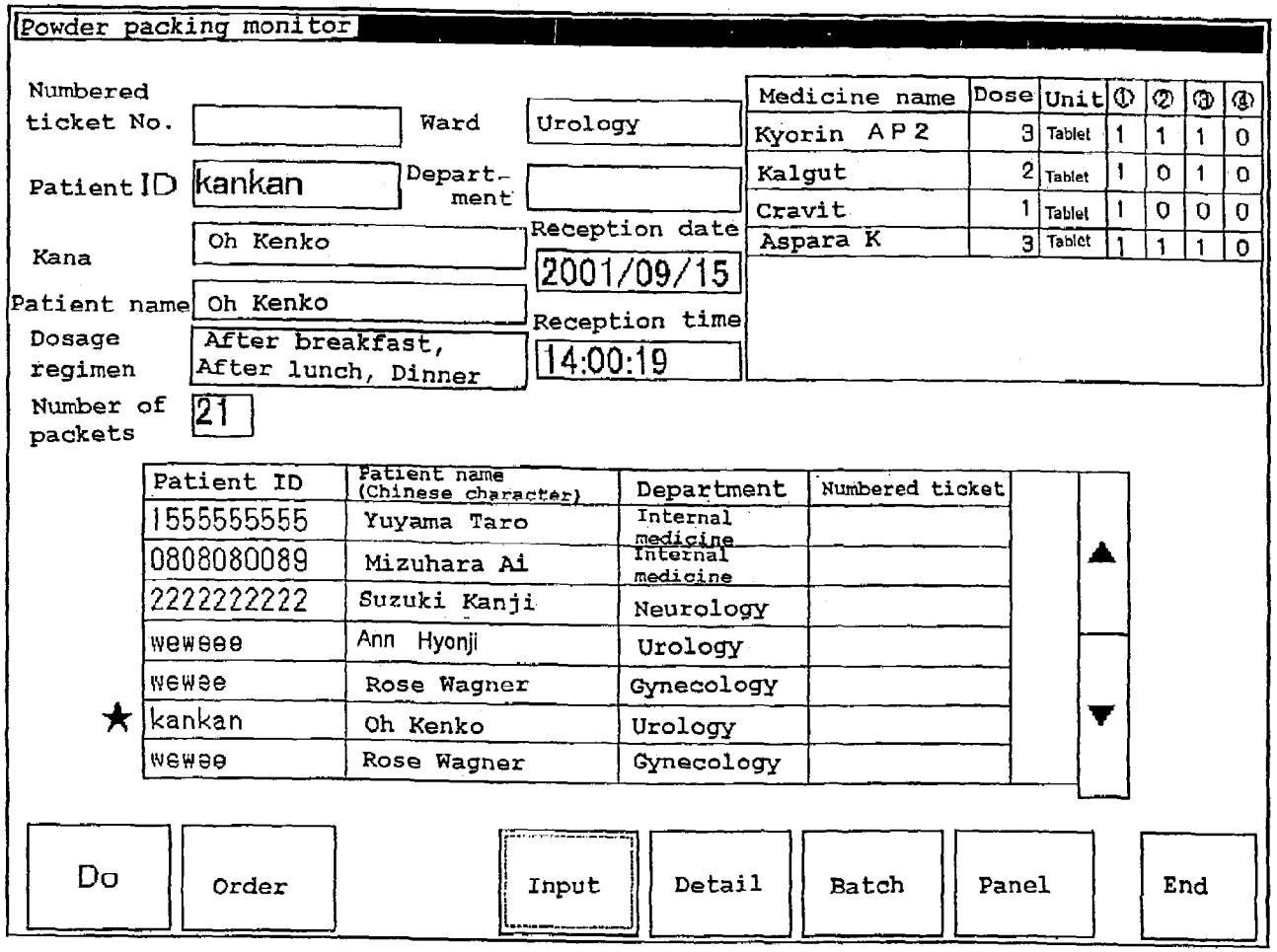
FIG. 6 is a view showing a packing monitor screen.

When the Job Start key is operated on the menu screen in FIG. 5, a packing monitor screen shown in FIG. 6 is displayed.

The packing monitor screen is constituted by a numbered ticket number, patient ID, kana, patient name, dosage regimen, number of packets, ward, department, reception date, reception time, prescription data display frame, data display column, DO Prescription Select key, Order key, Input key, Detail key, Batch key, Panel key and End key. Data of scheduled packing by a packing machine is displayed in each column of the data display column. Furthermore, a "★" mark is displayed to the left of a selected patient name among names displayed in the data display column, and prescribed medicine (agent) names and dosage regimen data are displayed in a list table at the upper right of the screen.

Figure 7:
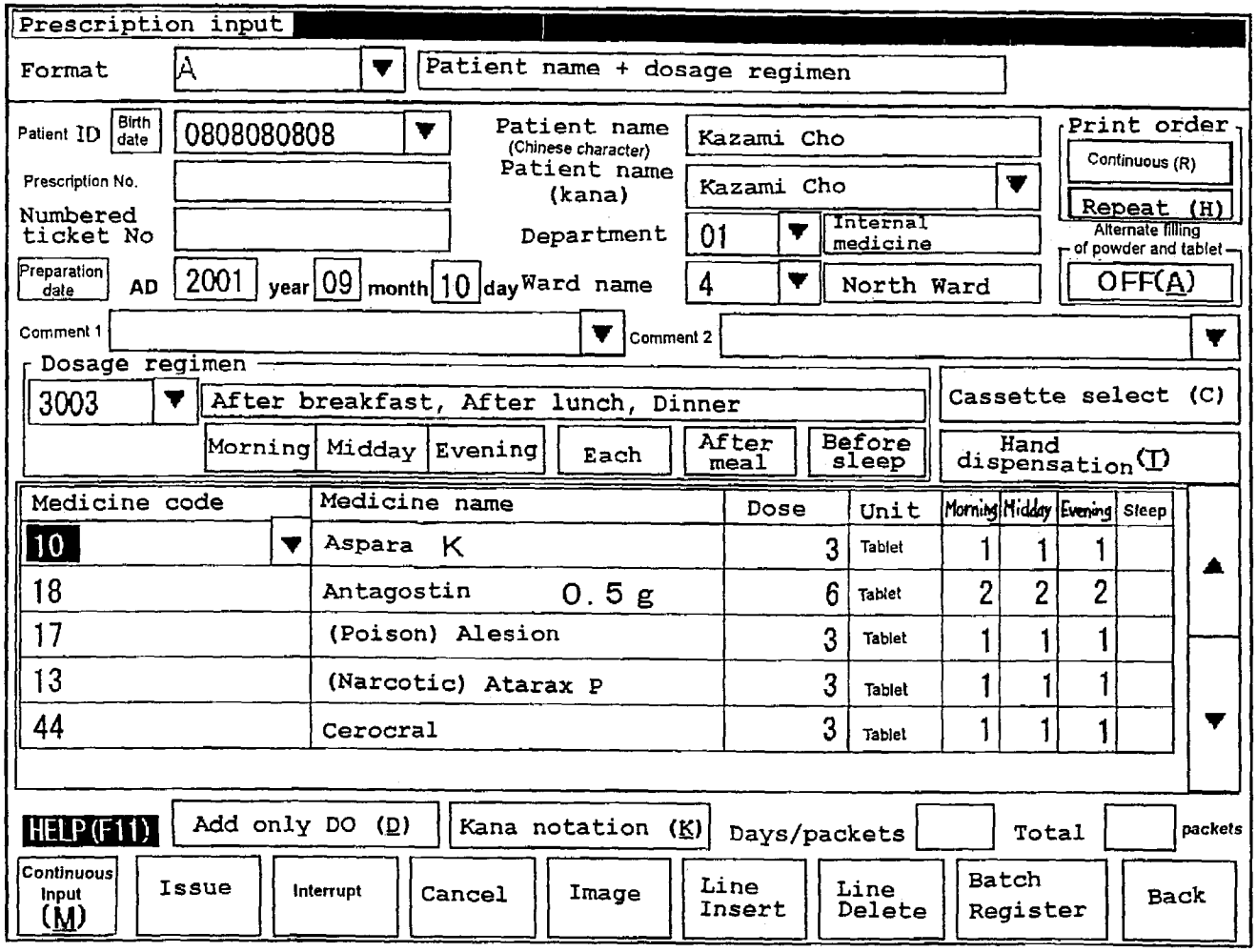
FIG. 7 is a view showing a prescription input screen.

When the Input key is operated on the packing monitor screen, a prescription input screen shown in FIG. 7 is displayed. The prescription input screen is constituted by a format column, patient ID column, patient name column, department column, ward name column, dosage regimen column, packet number column, Cassette Select key, Hand Dispensation Input key, Continuous Input key, Issue key, Interrupt key, Cancel key, Image key, Line Insert key, Line Delete key, Batch Register key and Back key. Prescription data such as patient data, medicine data and dosage regimen data is inputted in free columns on the prescription input screen based on a description of a prescription.

When a selection key "▼" in the format column is operated, print setup contents registered beforehand on a master maintenance screen shown in FIG. 14 described later can be selected.

When a selection key "▼" in the patient ID column is operated, a patient ID and a patient name (Chinese characters, kana) registered beforehand are displayed in a list. Therefore, a required patient can be easily selected. The patient ID can also be selected by operating a "Birth Date" key to input a birth date or inputting a patient name in a free column. Furthermore, since, when a patient name is inputted, character search is automatically performed during the process of the input, and all relevant names pop up as a list. Therefore, the name can be selected from the list. When the patient ID is inputted, a patient name is automatically displayed in the patient name column in Chinese characters and kana. Furthermore, when selection keys "▼" in the department column, ward name column and dosage regimen column are operated, corresponding lists pop up. Therefore, each item can be easily selected. When the dosage regimen is selected, a relevant key ("Morning", "Midday" or "Evening") is highlighted and stored data is changed. Notation of the key display can be changed between Chinese characters and kana by an operation for changing "Chinese Character Notation" or "Kana Notation". However, notation may be changed by other keys.

The medicine column is constituted by a medicine code, medicine name, dose, unit and taking time. A code number can be directly inputted in a free medicine code column. Alternatively, by operating this free column and operating a selection key "▼" displayed on the right side in the column to display a registered medicine list in a pop-up box, the code number can also be selected from the displayed list. When a code number is directly inputted in a free medicine code column to register a new medicine (agent), a medicine registration screen pops up, and various information can be inputted according to displayed contents (medicine name, unit code, dosage form etc.).

Furthermore, the dosage regimen data can also be inputted by operating the Cassette Select key. That is, when the Cassette Select key is operated, the prescription input screen is changed to a cassette selection screen shown in FIG. 8.

The cassette selection screen is constituted by an arrangement screen, Decision key, Temporary Alteration key, Temporary Initialization key and Back key.

Figure 8:
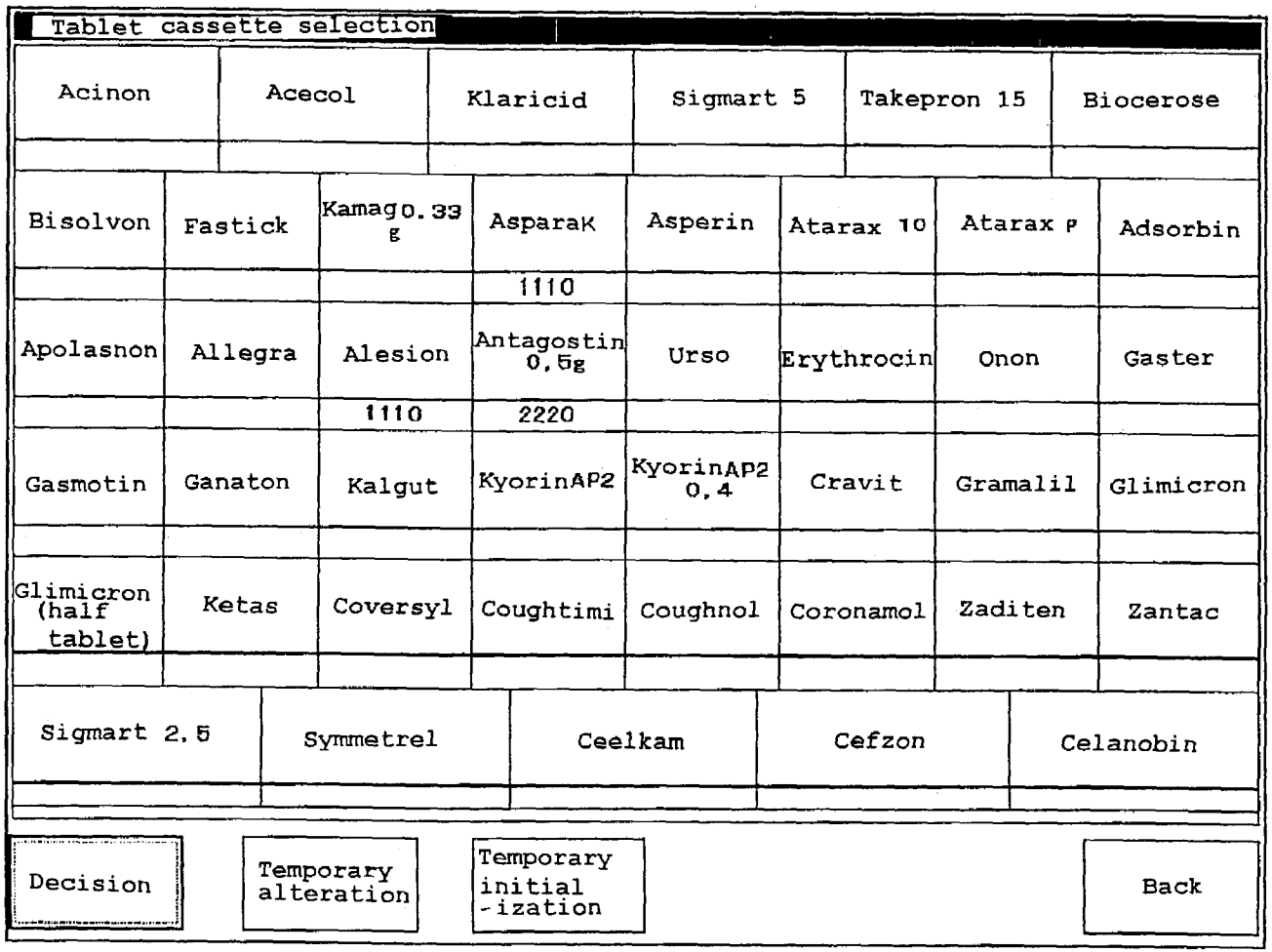
FIG. 8 is a view showing an arrangement screen.
Figure 9:
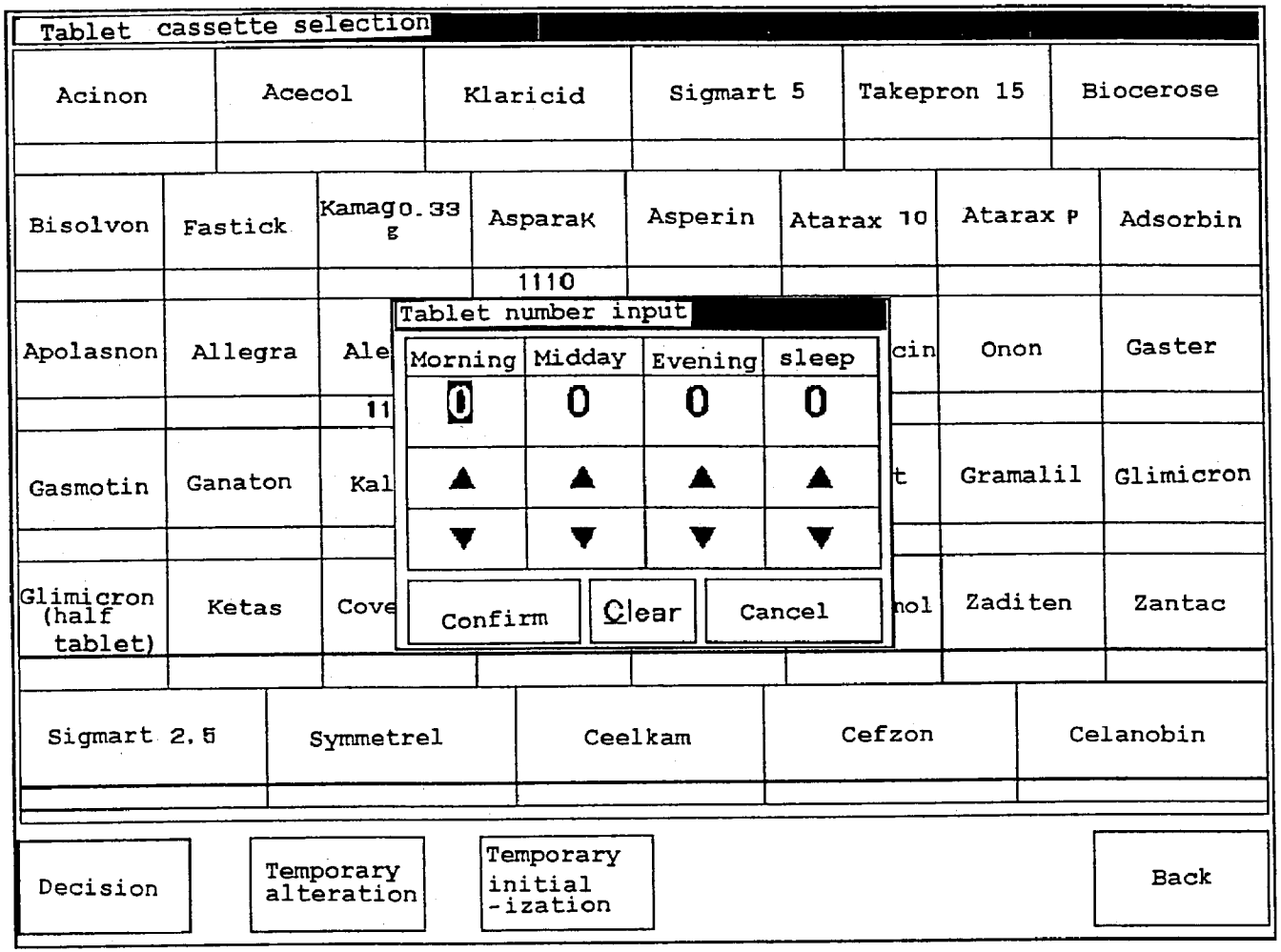
FIG. 9 is a view showing a medicine number input screen.

The arrangement screen shown in FIG. 8 is constituted by an arrangement view of medicine containers displayed so as to correspond to tablet cartridges 11 in the tablet housing rack 1, medicine names displayed in regions corresponding to the medicine containers in the arrangement view and dosage data column (medicine name "Aspara" in FIG. 8 is 1110). As the medicine name, a medicine name of a medicine actually housed in a region corresponding to an actual medicine container is displayed by allowing the reader 40 to read the medicine identification unit 16 of each tablet cartridge 11. When a region in which a medicine name is displayed is operated, the region is highlighted and a medicine number input screen pops up as shown in FIG. 9. Furthermore, when a medicine container is dismounted, the medicine name of the relevant region is deleted.

Figure 10:
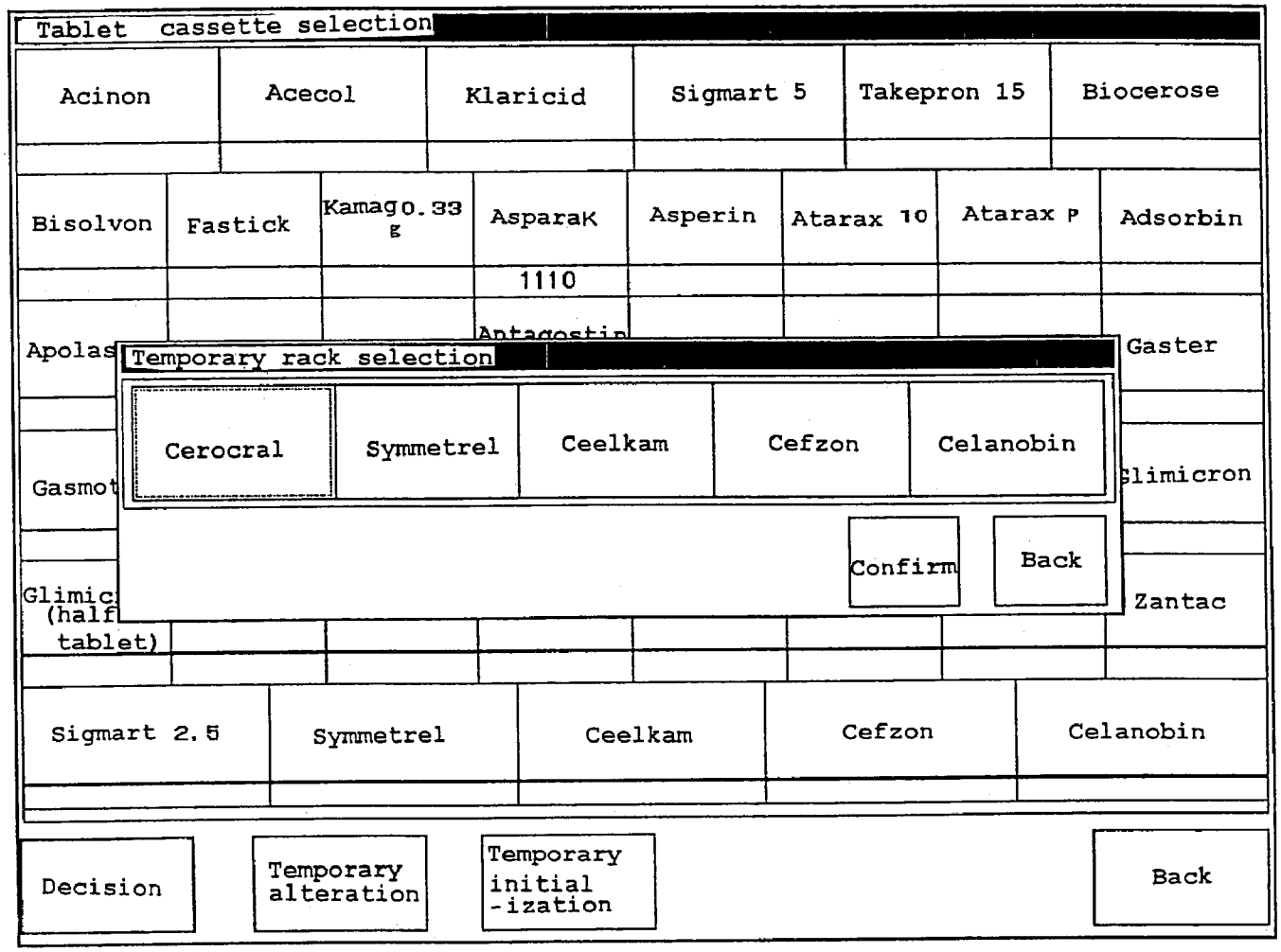
FIG. 10 is a view showing a state in which a temporary alteration key is operated in FIG. 8.
Figure 11:
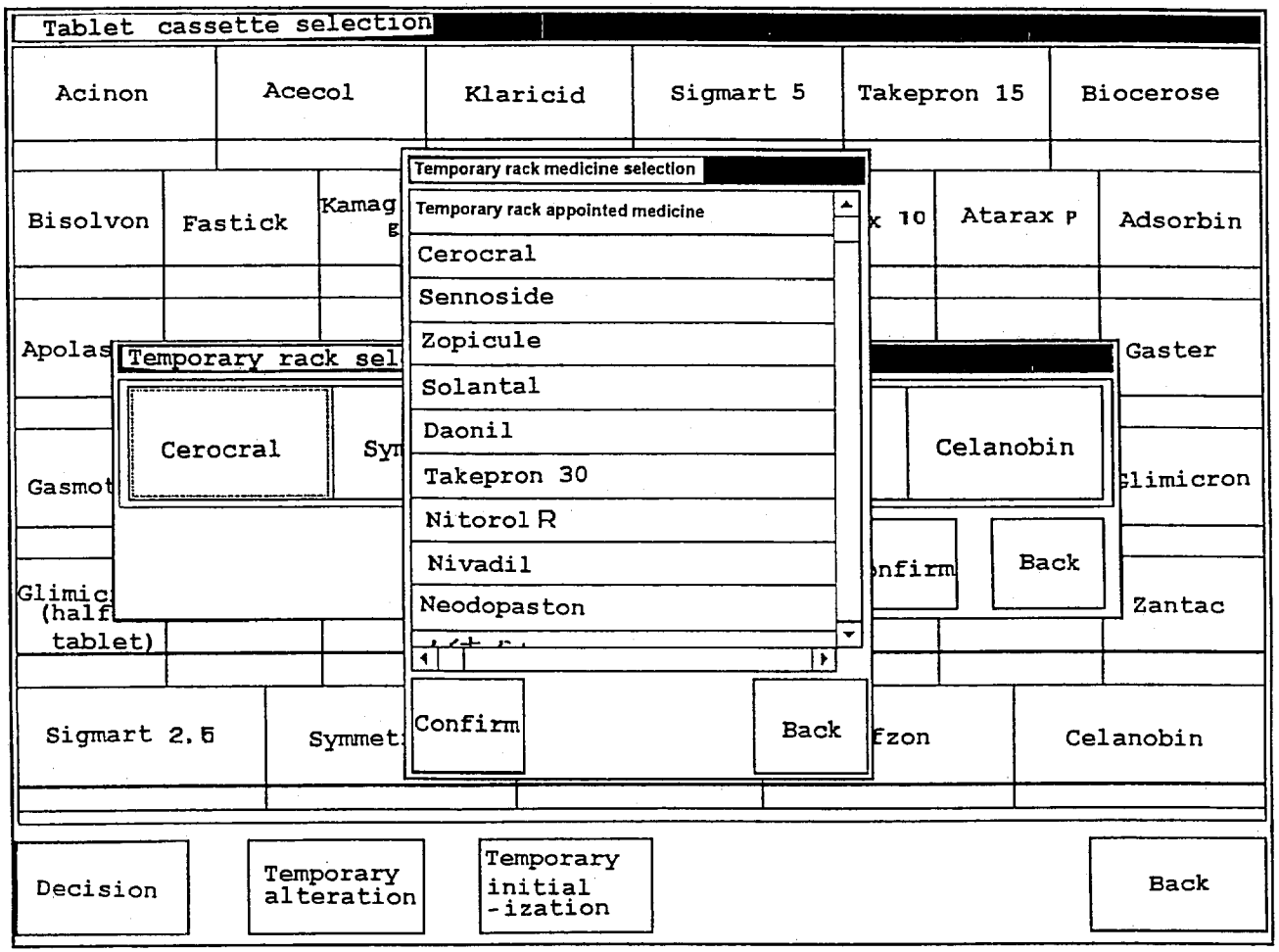
FIG. 11 is a view showing a state in which a medicine name is operated in FIG. 10.

The arrangement screen is constituted by a plurality of regions (cells) corresponding to housing sites in the tablet housing rack 1, and the lowermost stage corresponds to a free region that can be replaced by other medicines. When the Temporary Alteration key is operated, substitutable medicine names pop up as shown in FIG. 10 on the arrangement screen shown in FIG. 8. When a displayed medicine name is clicked, medicine names are displayed in a list as shown in FIG. 11. Therefore, a medicine desired to be substituted can be easily selected.

Furthermore, a type in which a tablet cartridge 11 is fixed on each shelf of the tablet housing rack 1 is displayed on the arrangement screen as shown in FIG. 1. However, when the housing rack is a cylinder of a rotary type, only a portion viewed in front can be displayed on the arrangement screen. In this case, it is sufficient that displays on the arrangement screen are successively changed by rotating the housing rack.

The medicine number input screen shown in FIG. 9 is constituted by taking time (Morning, Midday, Evening, Before Sleep), a free column for inputting number of medicines, UP key (▲), DOWN key (▼), Confirm key, Clear key and Cancel key. The number of medicines is inputted in each free column by the UP key (▲), DOWN key (▼) or ten keys (not shown). The whole free column can be reset to 0 by the Clear key, and the medicine number input screen can be deleted by the Cancel key. When the input of the number of medicines is completed, the dosage regimen data can be confirmed by operating the Confirm key.

When the Decision key is operated on the arrangement screen shown in FIG. 8, the dosage regimen data inputted on the medicine number input screen can be reflected in the medicine column. When the Temporary Alteration key is operated, a list table of medicines substitutable from the housing racks 1, 2 pops up. When the Temporary Initialization key is operated, a display of the lowermost stage on the arrangement screen is changed to an initial display. When the Back key is operated, the screen is changed to the prescription input screen.

Figure 12:
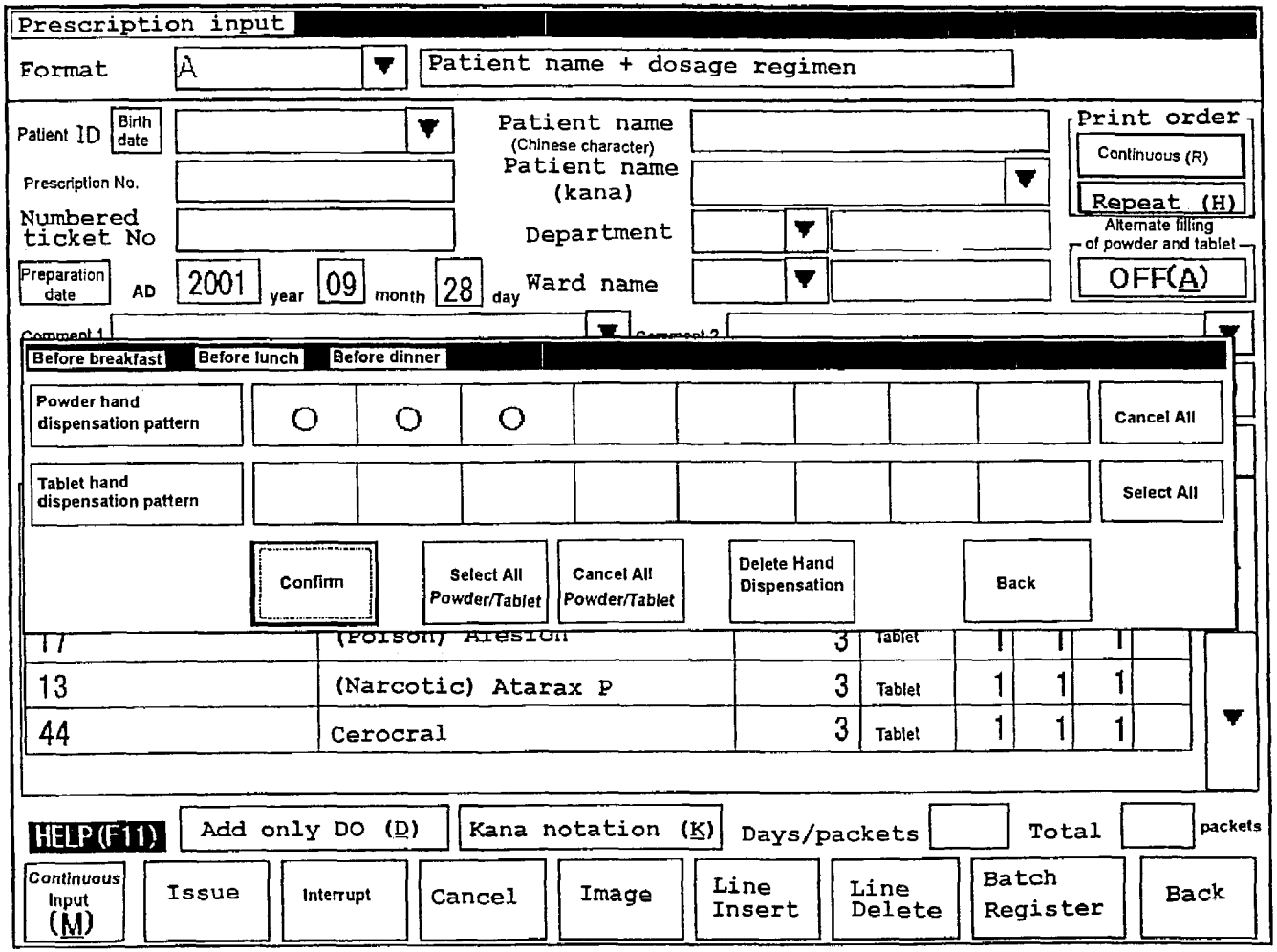
FIG. 12 is a view showing a hand dispensation pattern.

When the Hand Dispensation Input key is operated on the prescription input screen shown in FIG. 7, a table of a hand dispensation pattern of powder and tablets pops up as shown in FIG. 12. Therefore, it is sufficient to select taking time that requires a hand dispensation.

Furthermore, when the continuous Input key is operated on the prescription input screen shown in the FIG. 7, prescription data can be continuously inputted for a specific patient. When the Issue key is operated, the inputted prescription data is reflected in the medicine column on the packing monitor screen. When the Interrupt key is operated, prescription data of other priority patients can be inputted. It is noted that the input data can be deleted by the Cancel key.

Figure 13:
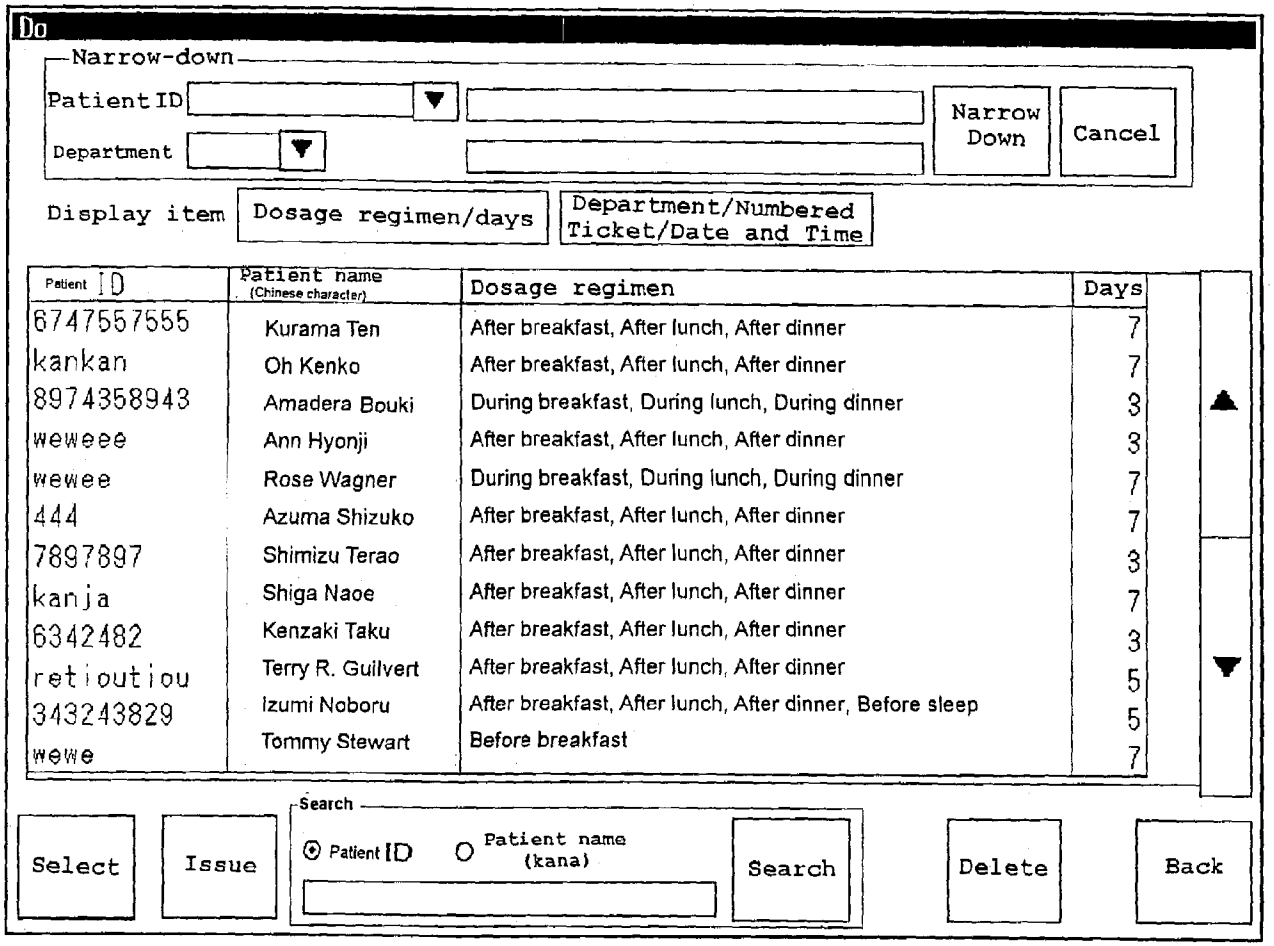
FIG. 13 is a view showing a DO prescription screen.

When a DO key is operated on the packing monitor screen shown in the FIG. 6, the screen is changed to a DO prescription screen as shown in FIG. 13. Registered data about a patient with prescribed data is displayed on this screen and is reused or used by partially correcting the data.

The DO prescription screen shown in FIG. 13 is constituted by a narrow-down column for narrowing down patients subjected to prescription, a list table composed of patient names and dosage regimens, Select key, Issue key, search column, Delete key and Back key.

A patient ID and a department can be inputted in the narrow-down column. The patient ID can be directly inputted by ten keys or the like, or, after a list table of patient ID and patient names pops up by operating the Select key, the patient ID can be selected. Furthermore, the department can also be inputted by direct input or popup display. When a Narrow-Down key is operated after inputting the department only, all relevant patients can be displayed in a list table. The inputted patient ID and the department can be reset by operating the Cancel key. In addition to the patient ID and patient name, the displayed list table includes a dosage regimen name and duration of dosage regimen (days), which can be displayed by operating a Dosage Regimen/Duration key, or a department, numbered ticket and processing date and time, which can be displayed by operating a Department/Numbered Ticket/Date and Time key. When the Select key is operated, the screen is changed to the prescription data screen, and the previous prescription contents are displayed in detail. The prescription contents can be similarly changed on the prescription data screen. When the Issue key is operated, a patient name or the like selected in the data display column is added when the packing monitor screen is recovered. In the search column, a patient ID or a patient name (kana) is inputted in a free column. When the Search key is operated, a line of a relevant patient in the list table is identified (color is changed). When the Delete key is operated, data of the selected line is deleted. The packing monitor screen is recovered by operating the Back key.

When the Detail key is operated in the packing monitor screen shown in FIG. 6, detail contents of past prescription data of a selected patient are displayed. When the Batch key is operated, the prescription data can be inputted in a batch. When the Panel key is operated, the inputted data can be deleted. The screen is changed to the initial screen by operating the End key.

When the Setup key is operated on the menu screen shown in FIG. 5, the screen is changed to a master maintenance screen shown in FIGS. 14–23. The master maintenance screen has a patient registration tab, department registration tab, dosage regimen registration tab, batch code registration tab, medicine registration tab, ward registration tab, comment registration tab, unit code registration tab, mounted medicine registration tab and pharmacist registration tab in the upper portion. Furthermore, the screen has a Search key, New key, Register key, Delete key, Print key and End key in a lower portion. By operating the Search key while data is inputted in a free column, relevant data can be displayed in the uppermost portion of a list table. The New key is used when new data is inputted. A free line can be inserted in the list table by operating the New key, and, after new data is inputted, data can be updated by operating the Register key. Furthermore, when a line to be deleted is selected and the Delete key is operated, a pop-up box ("Do you want to delete selected data?") is displayed. By operating "YES", the selected data can be deleted.

Figure 14:
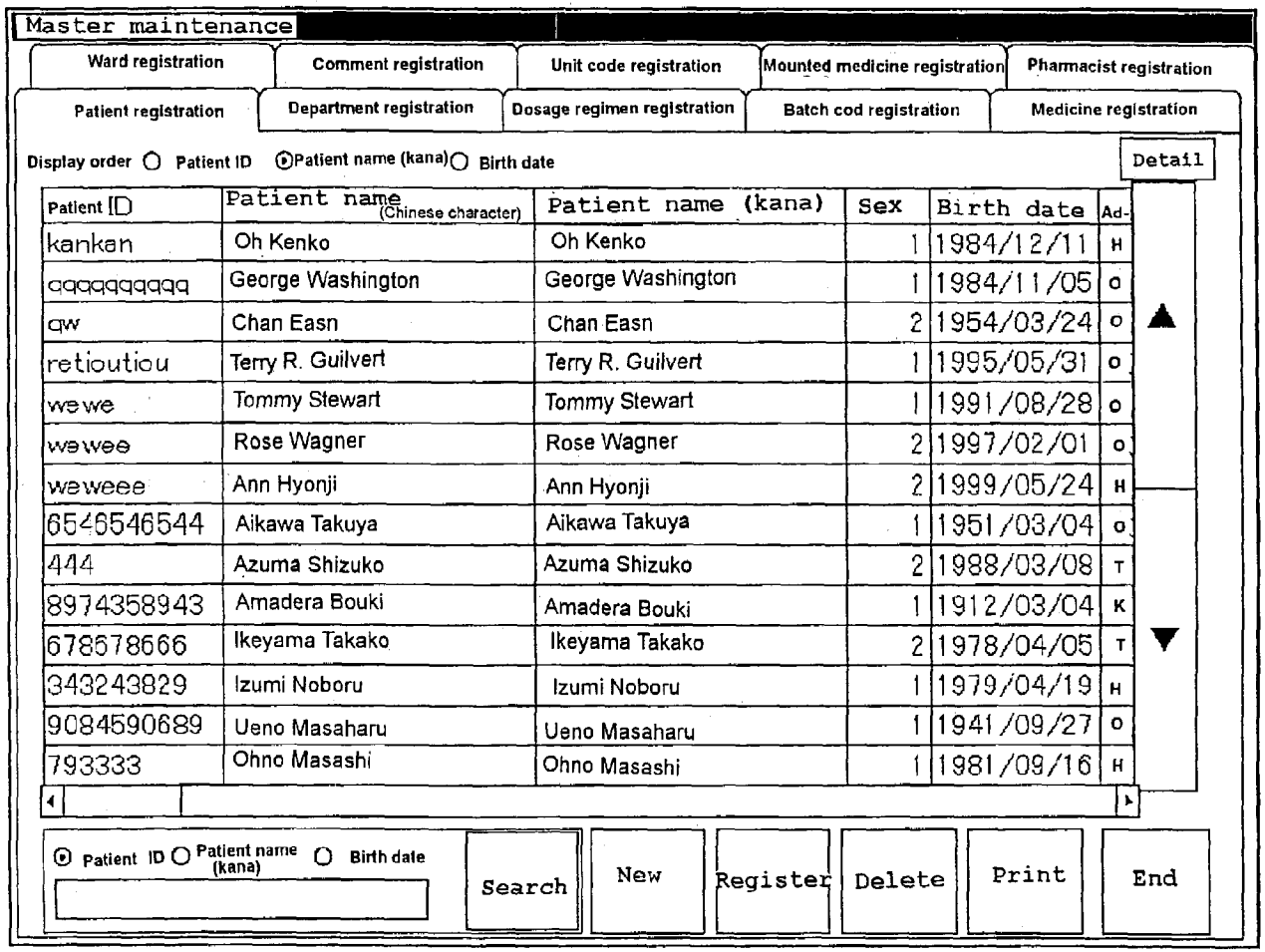
FIG. 14 is a view showing a state in which a patient registration tab is operated on a master maintenance screen.

When the patient registration tab is operated, patient names etc. shown in FIG. 14 are displayed in a list. By selecting any of items described in the order of the display in an upper portion, the patient ID, patient name (kana) or birth date can be re-arranged in a descending order (or ascending order). When the patient name or the like is inputted in the free column in the lower portion while any of the patient ID, patient name (kana) or birth date thereabove is selected, and the Search key is operated, a search object can be displayed in the uppermost portion of the display column.

Figure 15:
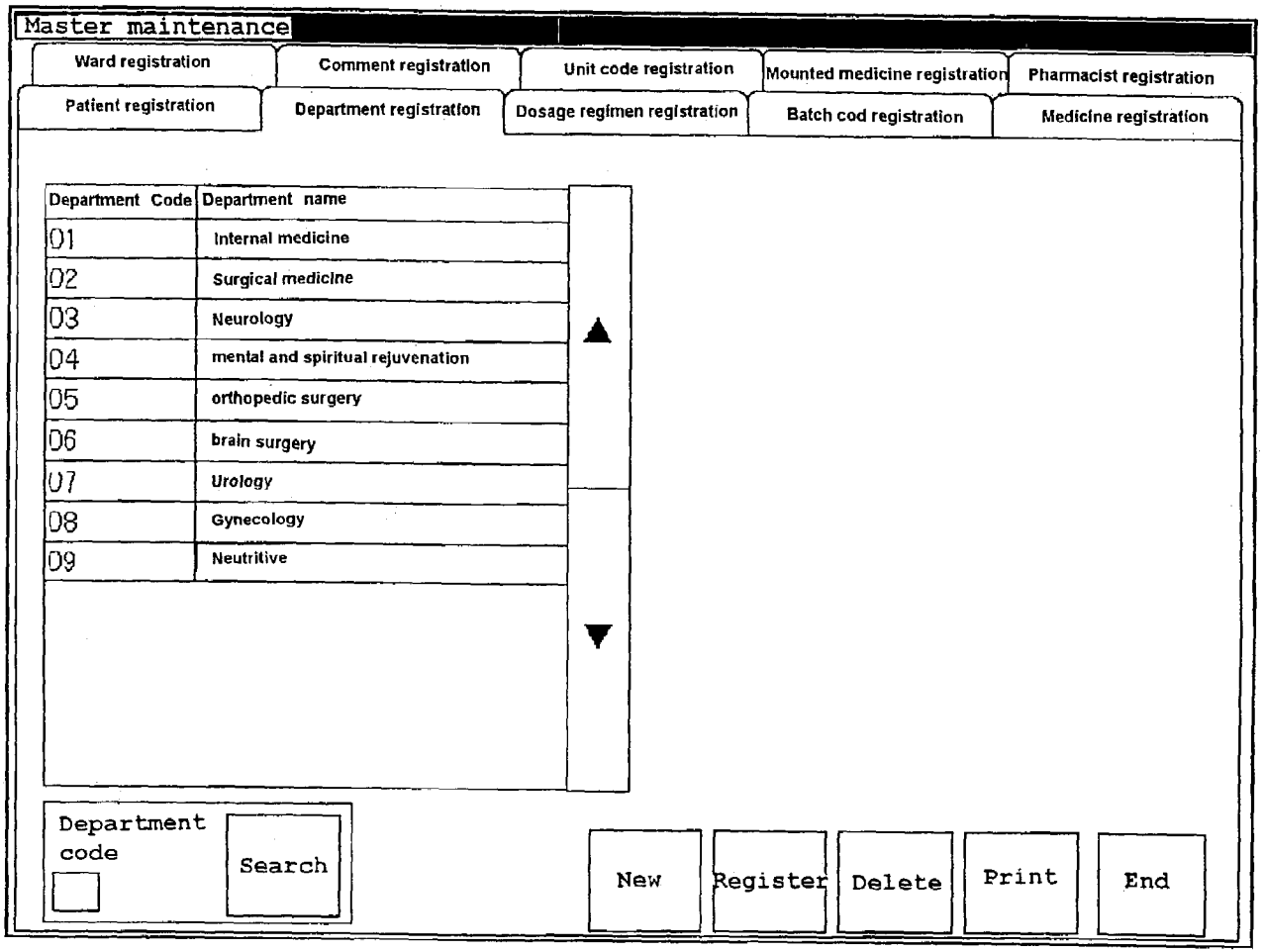
FIG. 15 is a view showing a state in which a treatment department registration tab is operated in the master maintenance screen.

When the department registration tab is operated, a department registration screen constituted by a list table of department codes and department names shown in FIG. 15 is displayed.

Figure 16:
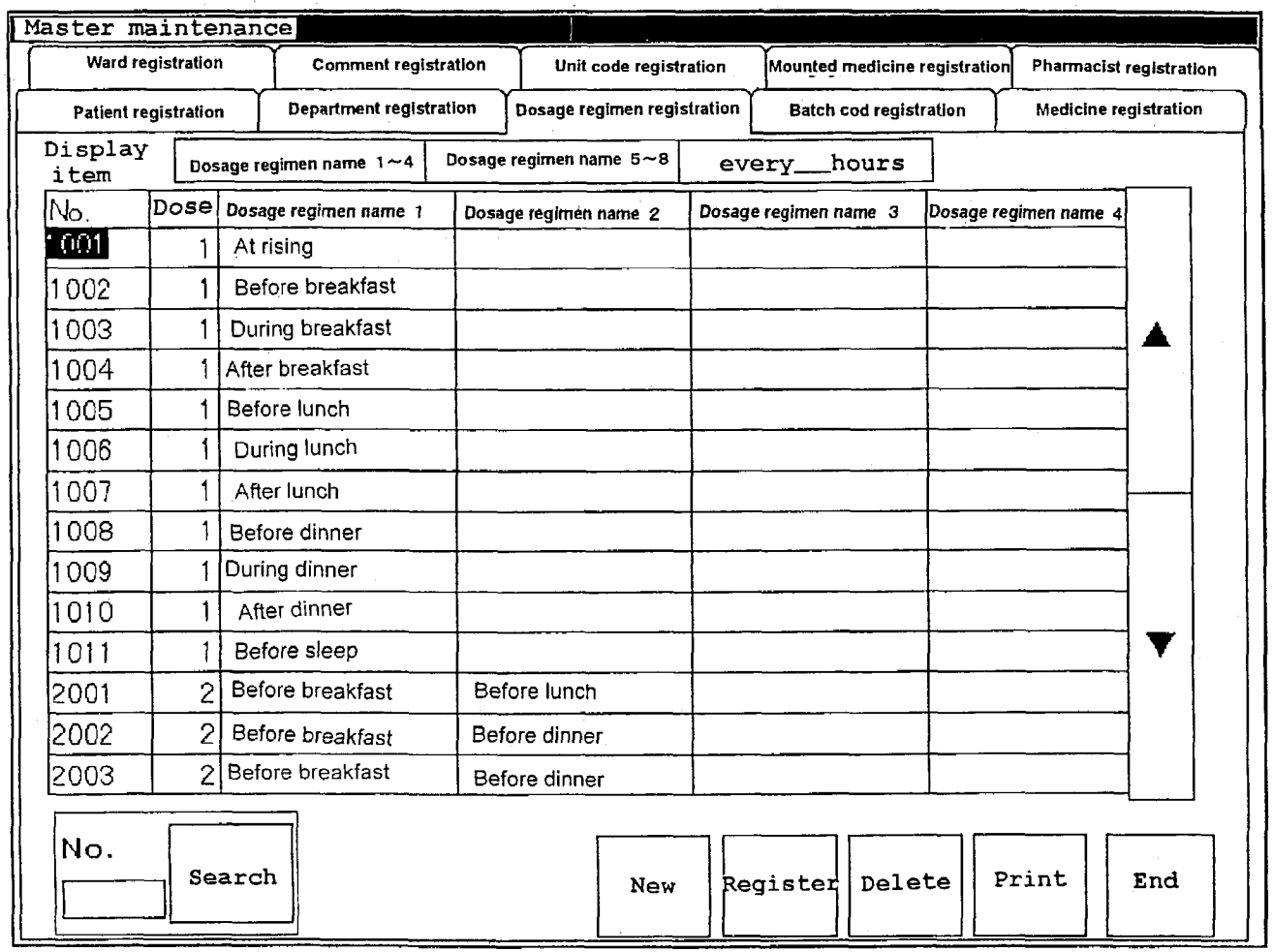
FIG. 16 is a view showing a state in which a dosage regimen registration tab is operated on the master maintenance screen.

When the dosage regimen registration tab is operated, a dosage regimen registration screen constituted by a list table of dosage regimen numbers and dosage regimen names is displayed as shown in FIG. 16. Data registered on this screen is used, for example, as control data for performing packing by a medicine packing machine in the order of medication or creating print data.

Figure 17:
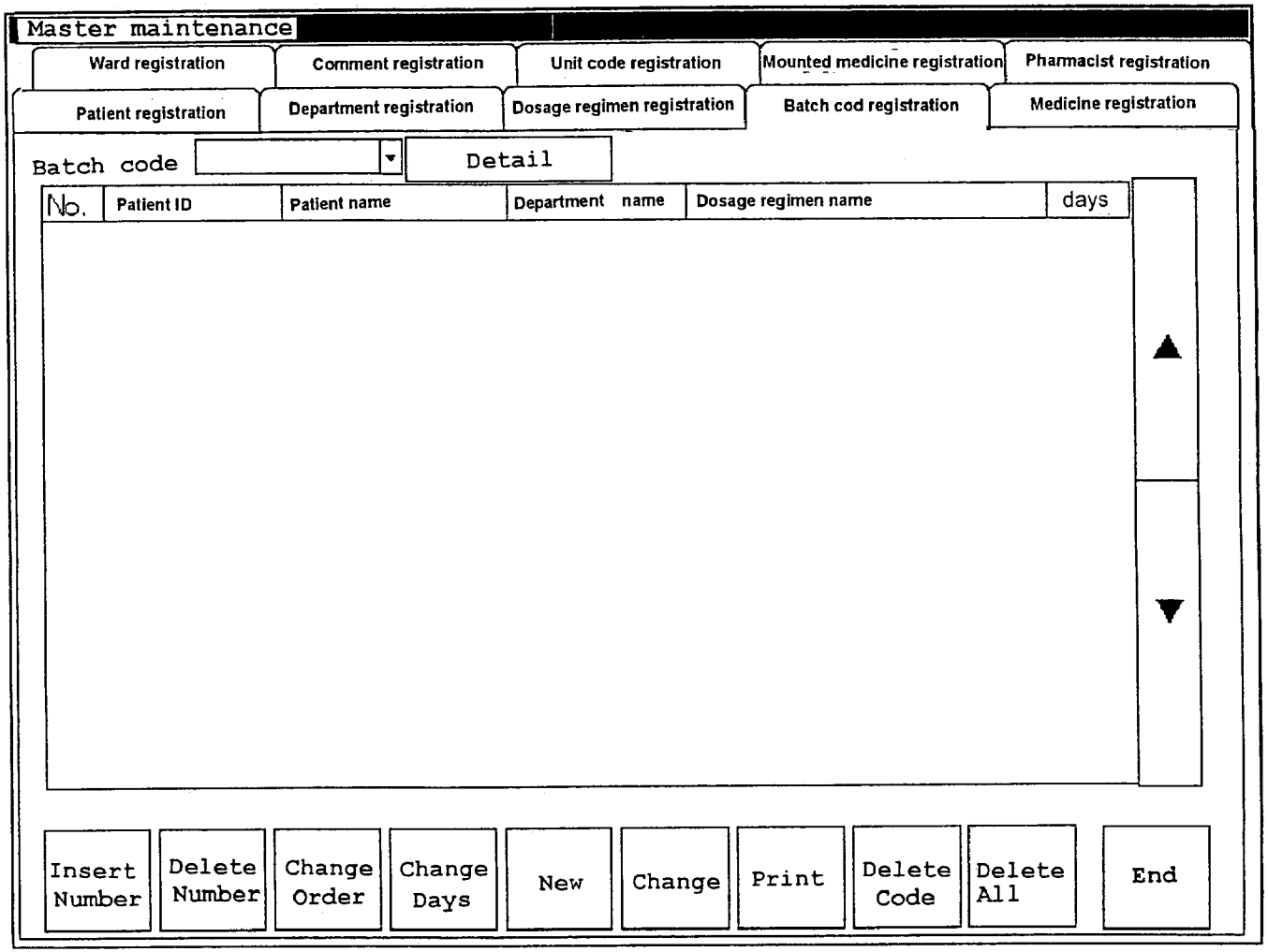
FIG. 17 is a view showing a state in which a batch code registration tab is operated on the master maintenance screen.

When the batch code registration tab is operated, a batch code registration screen shown in FIG. 17 is displayed. This screen is used when prescription data is inputted as a batch.

Figure 18:
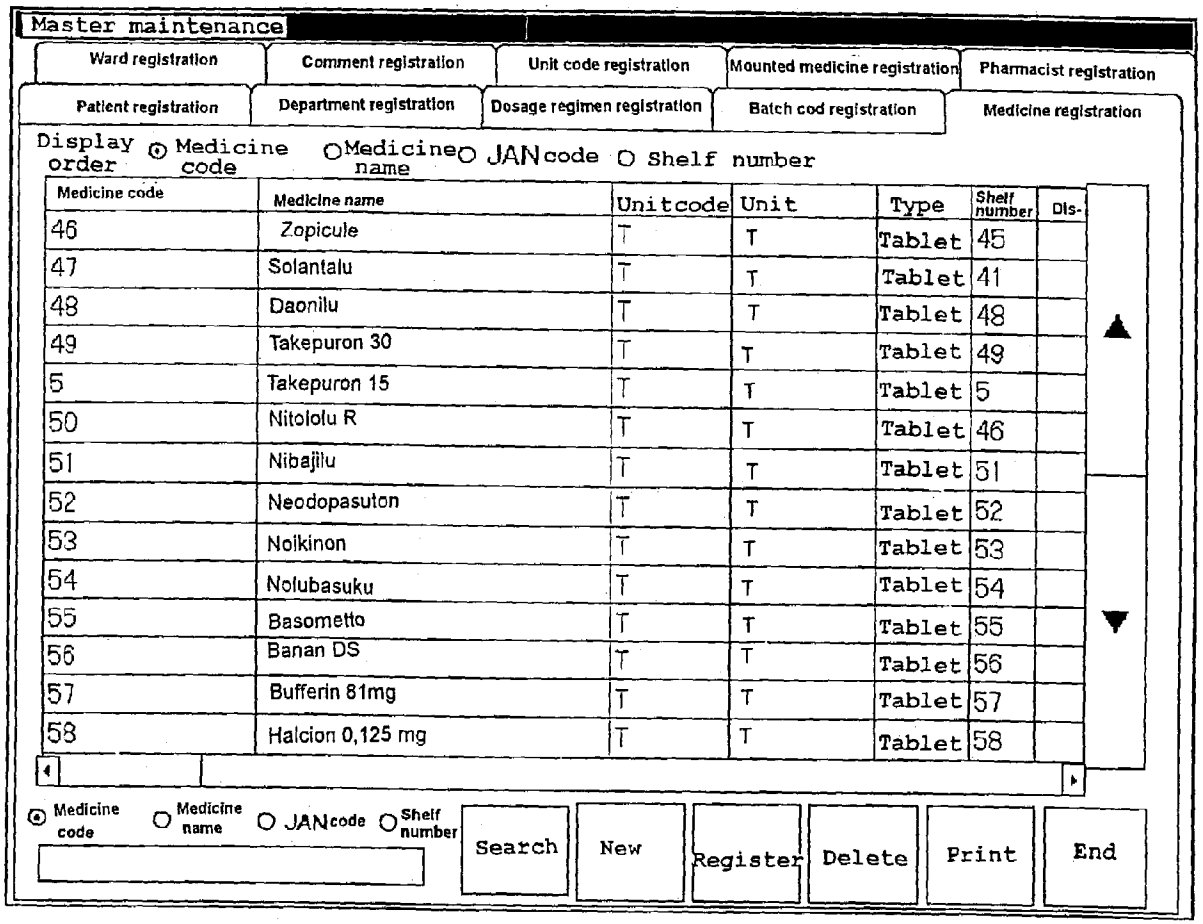
FIG. 18 is a view showing a state in which a medicine registration tab is operated on the master maintenance screen.

When the medicine registration tab is operated, a medicine registration screen constituted by a medicine registration list shown in FIG. 18 is displayed. The medicine registration list is constituted by a medicine code, medicine name, upper limit of stock, unit code, unit, medicine type, shelf number, ID, abbreviated name, marking, JAN code and management flag. The medicine code is a code number set for each drug (medicine). The medicine name is a name of a drug (medicine). The upper limit of stock is an upper limit of the number of medicines that can be contained in a cartridge 11. The unit code is a code unique to each medicine, which is a code obtained by shortening an abbreviated name of a medicine so that a pharmacist can easily input the code. For example, in the case of a medicine C for external use, its code is "EXT.C" from "the medicine C for external use". The unit is a name of a unit when a medicine is prepared. CAP is used for "capsule", T is used for "tablet", g is used for "gram", ml is used for "milliliter" and so forth. The type is a form of a medicine. Here, tablet and powder are disclosed. The shelf number is a number of a shelf of each tablet feeder 34 on which a tablet cartridge 11 is placed. The ID is an ID number of a tablet cartridge 11. The abbreviated name is an abbreviated name of a medicine. The marking is a marking for identification formed in a tablet. The JAN code corresponds to the shelf number and used for search. The management flag is used as a marking for a medicine requiring management such as a dangerous medicine.

Figure 19:
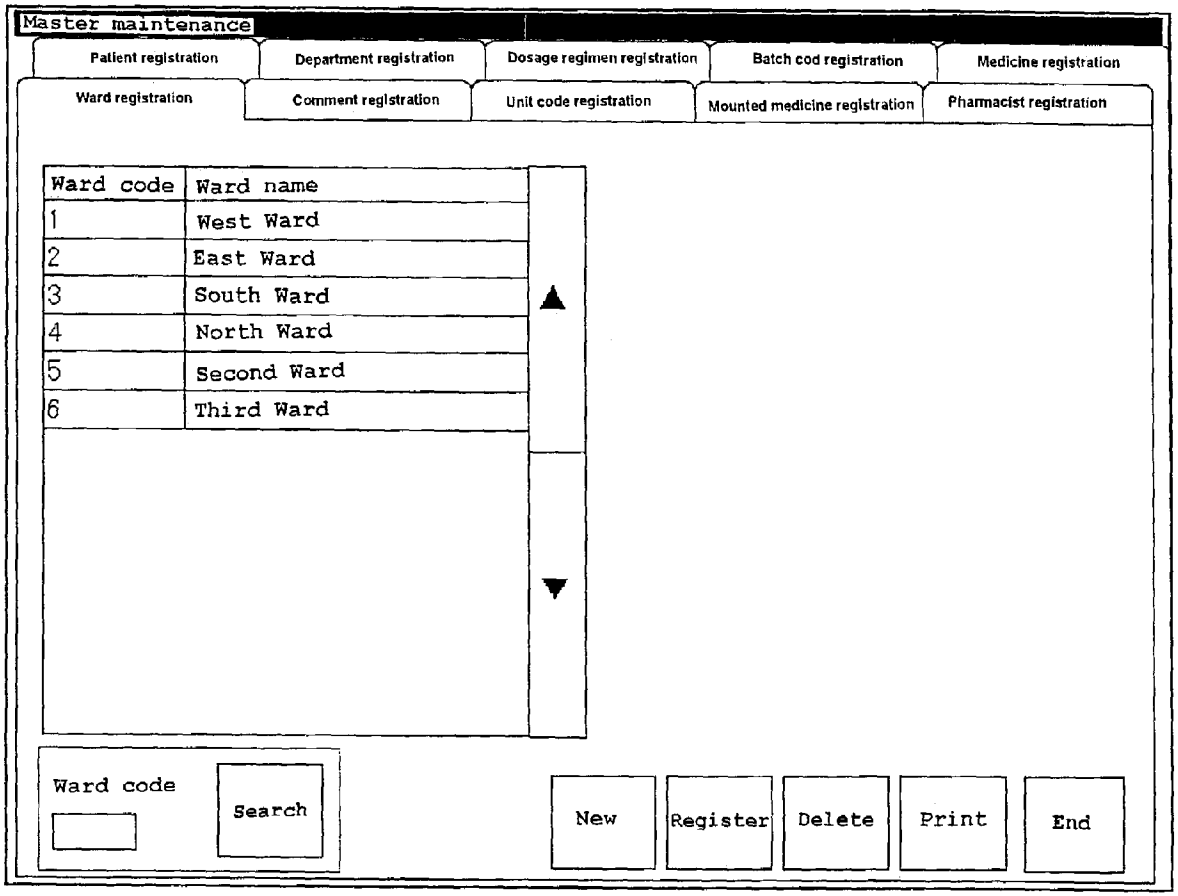
FIG. 19 is a view showing a state in which a ward registration tab is operated on the master maintenance screen.

When the ward registration tab is operated, a ward registration screen constituted by ward names shown in FIG. 19 is displayed, and registration, deletion, change or the like can be freely performed.

Figure 20:
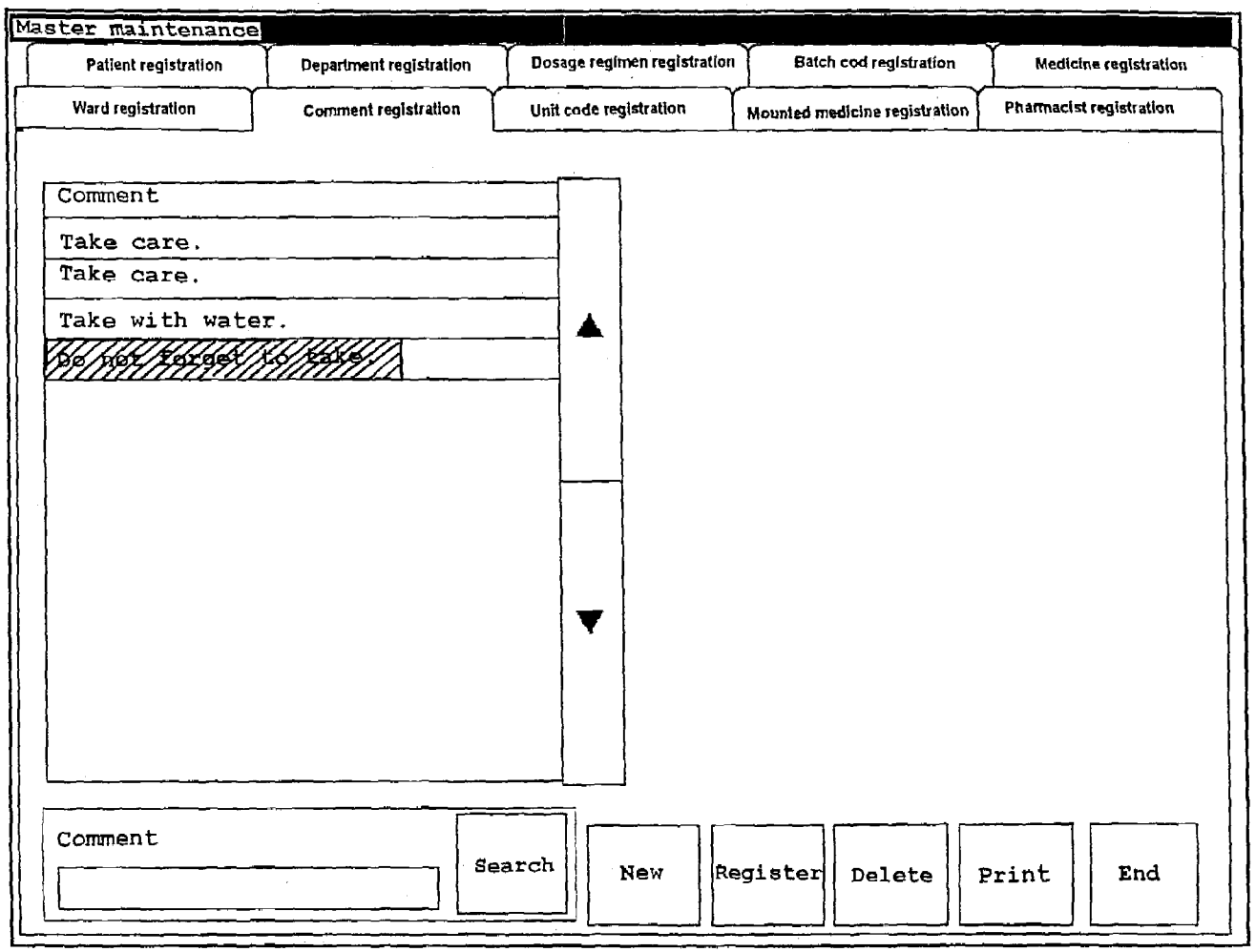
FIG. 20 is a view showing a state in which a comment registration tab is operated on the master maintenance screen.

When the comment registration tab is operated, a comment registration screen constituted by comments shown in FIG. 20 is displayed, and print data to be printed on a medicine packet can be registered.

Figure 21:
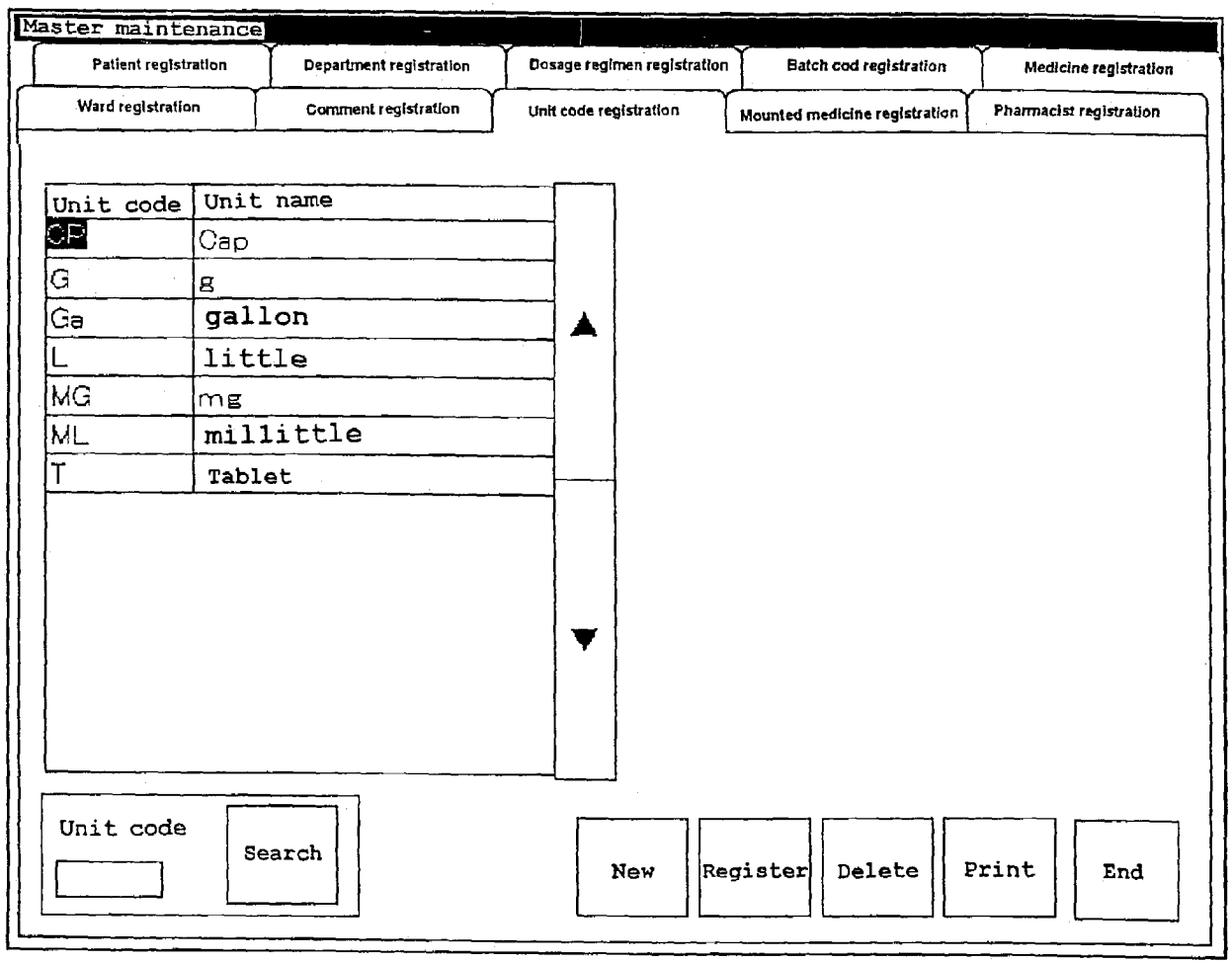
FIG. 21 is a view showing that a unit code registration tab is operated on the master maintenance screen.

When the unit code registration tab is operated, a unit registration screen constituted by unit codes and unit names shown in FIG. 21 is displayed.

Figure 22:
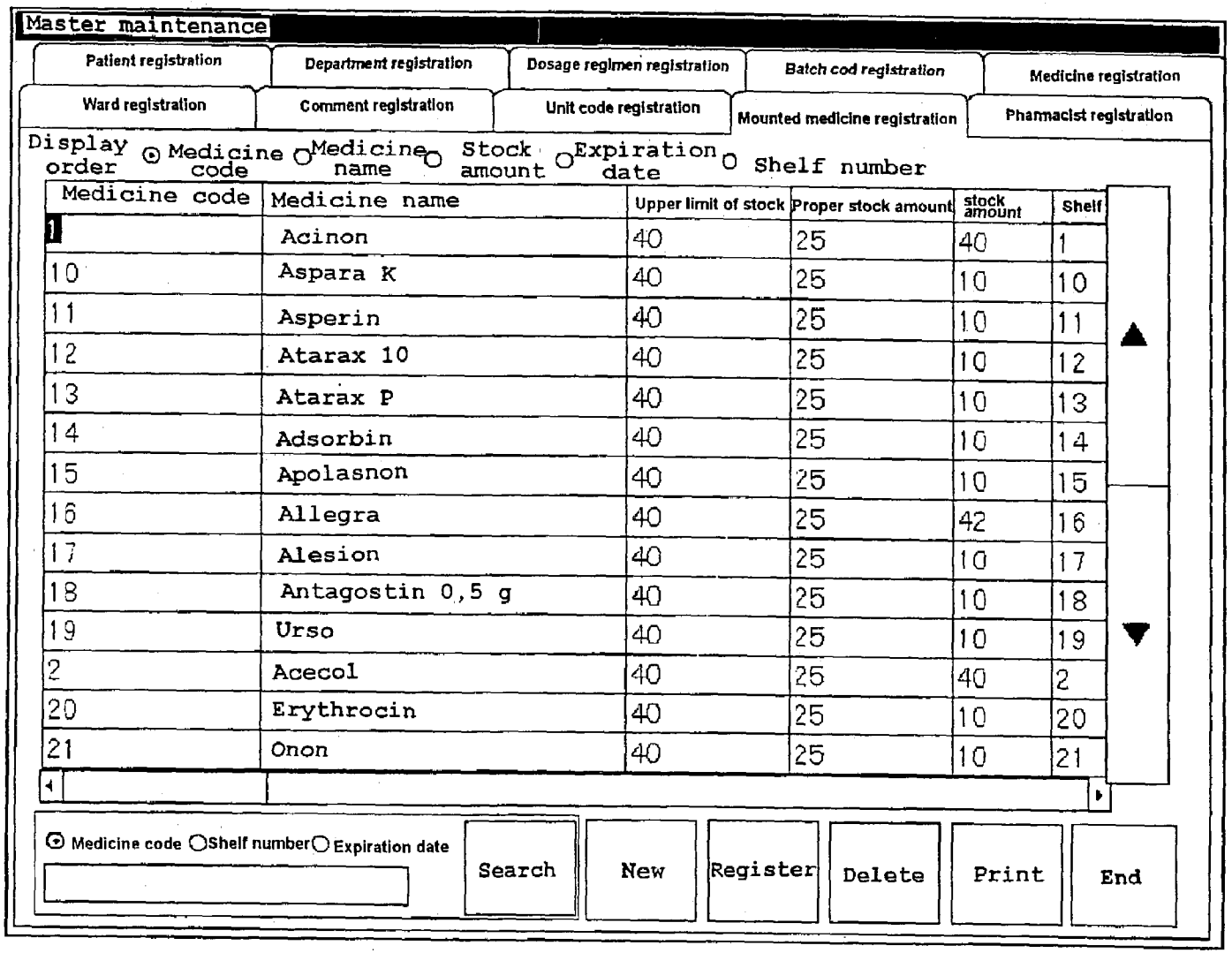
FIG. 22 is a view showing a state in which a mounted medicine registration tab is operated on the master maintenance screen.

When the mounted medicine registration tab is operated, a mounted medicine registration screen constituted by a mounted medicine list is displayed as shown in FIG. 22. The mounted medicine list is constituted by a medicine code, medicine name, upper limit of stock, proper stock amount, lot number and expiration date. Here, passing expiration or being close to expiration in an actual prescription period is determined based on a registered expiration date.

Figure 23:
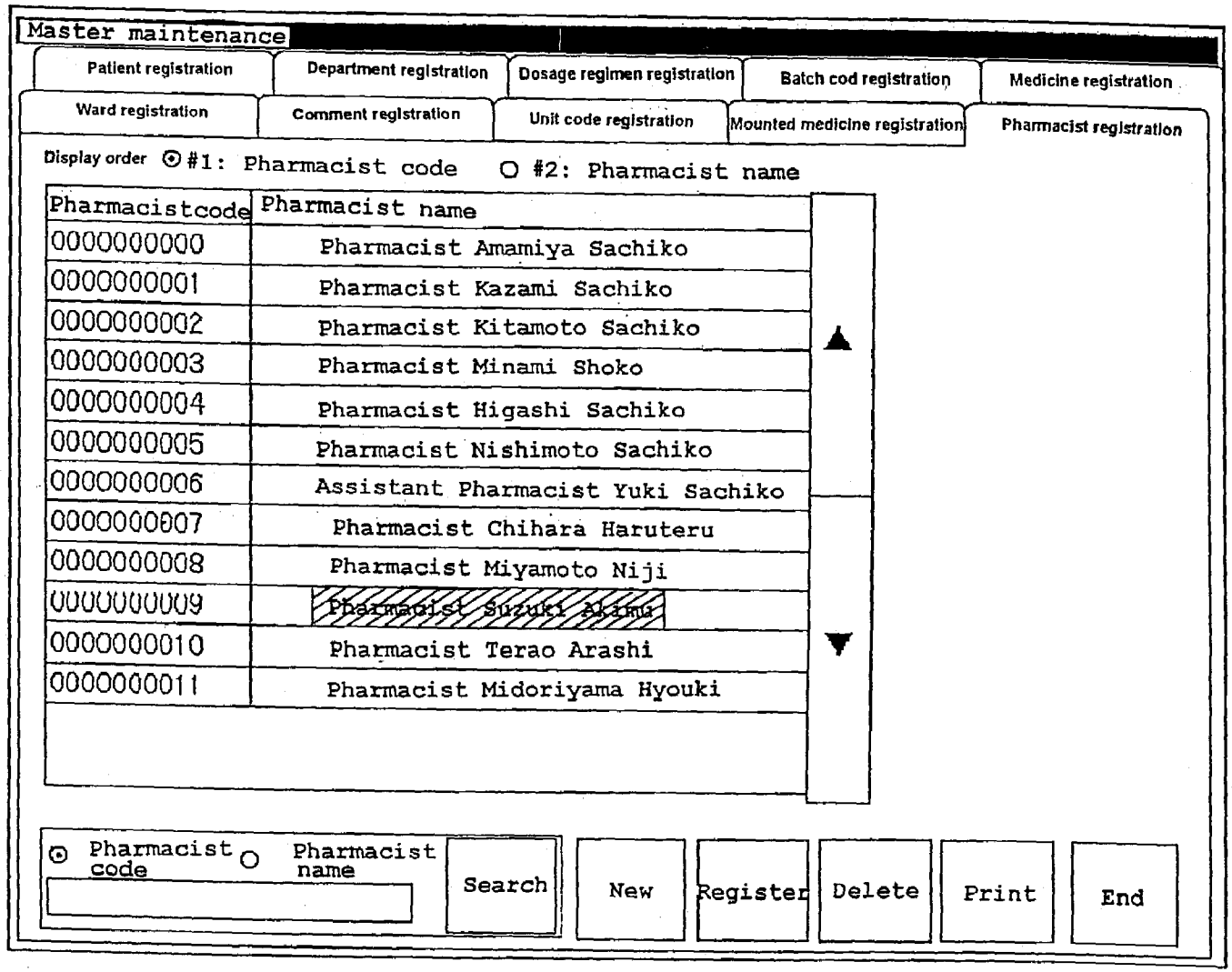
FIG. 23 is a view showing a state in which a pharmacist registration tab is operated on the master maintenance screen.

When the pharmacist registration tab is operated, a pharmacist registration screen constituted by a pharmacist registration list shown in FIG. 23 is displayed.

Figure 24:
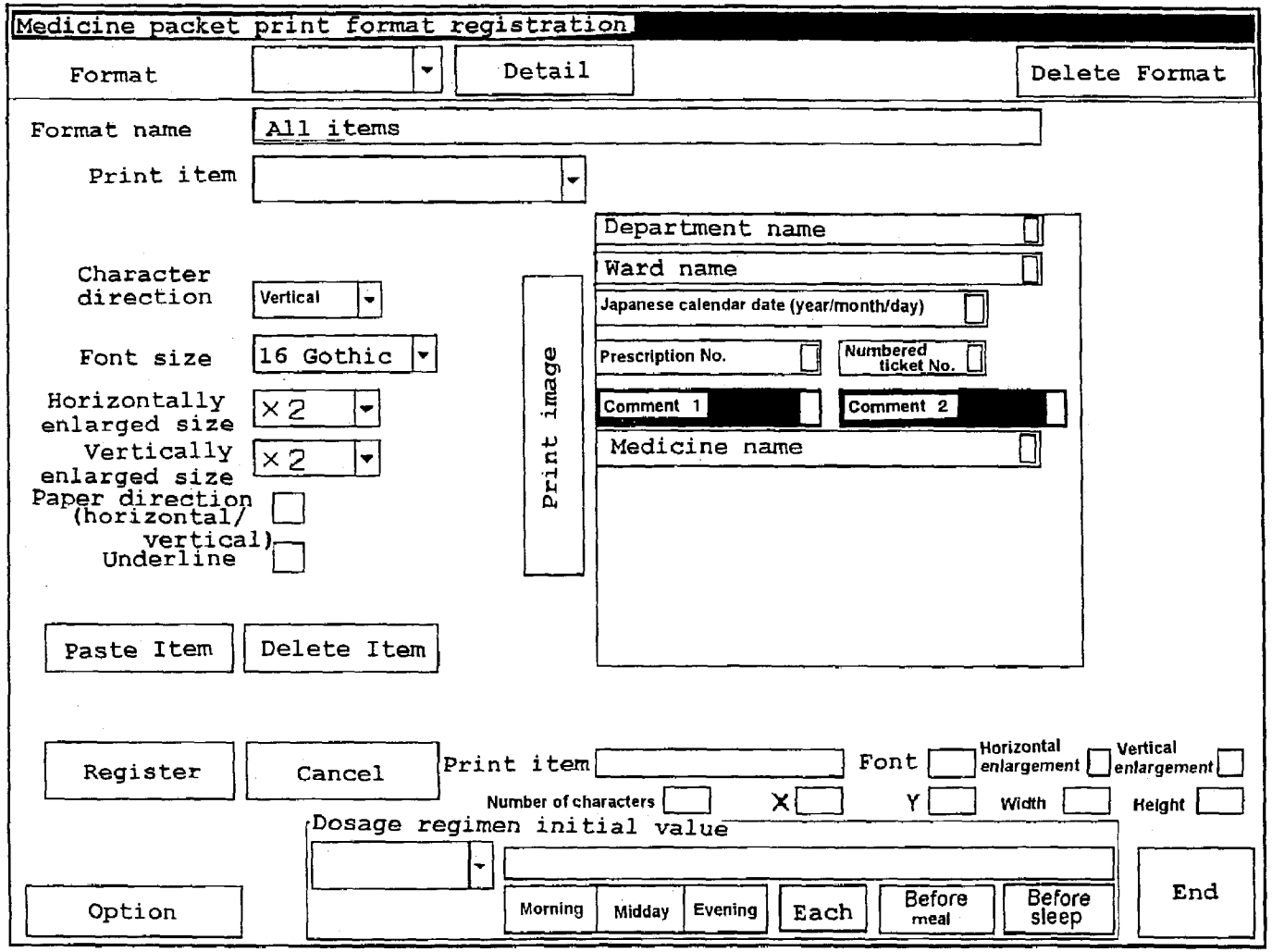
FIG. 24 is a view showing a medicine packet printing format registration screen.

When the Print Setup key is operated on the menu screen shown in FIG. 5, a medicine packet printing format registration screen shown in FIG. 24 is displayed. On this screen, when any of formats registered in a format column in the upper portion beforehand is selected and the Detail key is operated, a print screen corresponding to the registered format is displayed.

Figure 25:
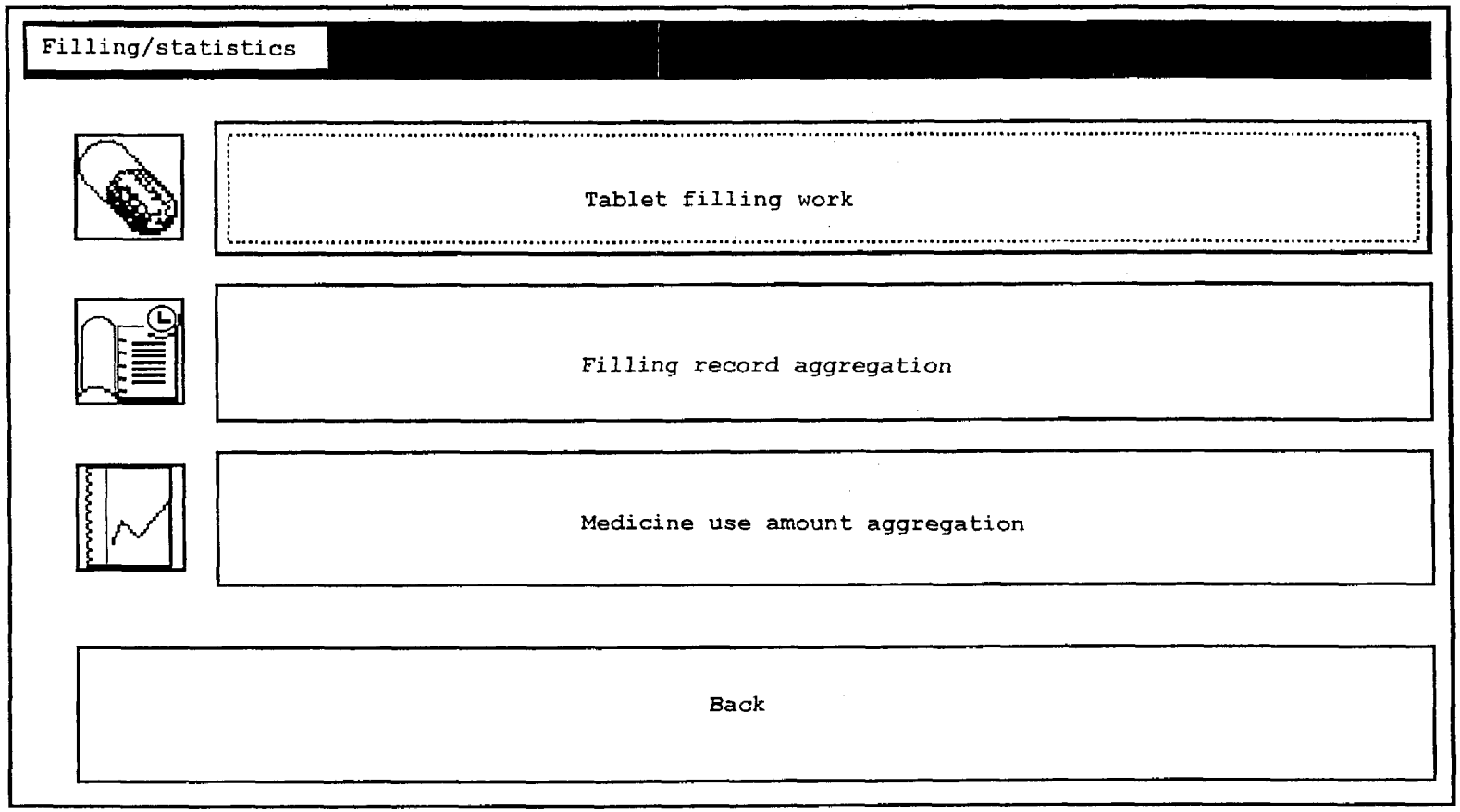
FIG. 25 is a view showing a filling/statistics selection screen.
Figure 26:
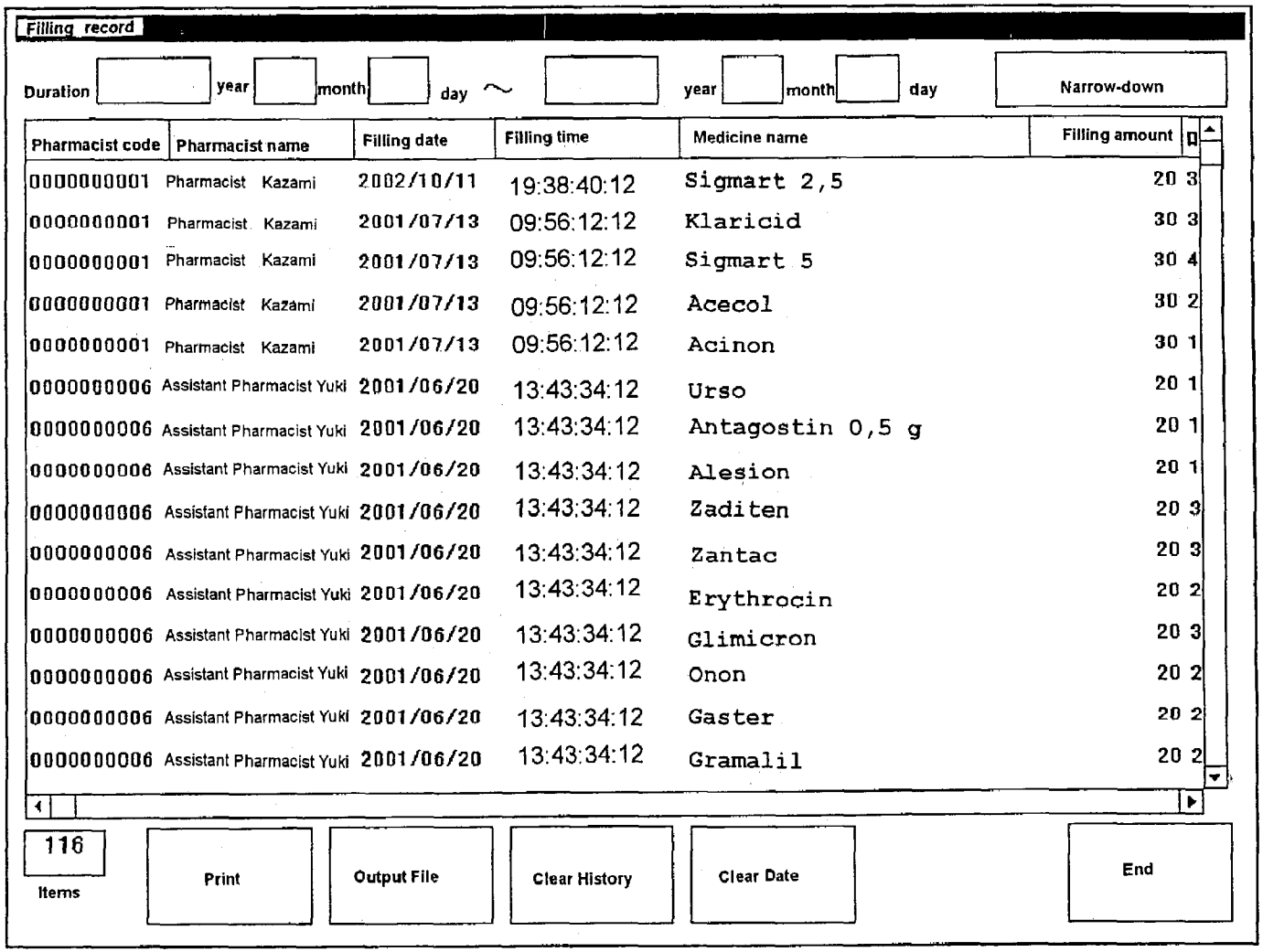
FIG. 26 is a view showing a filling work screen.
Figure 27:
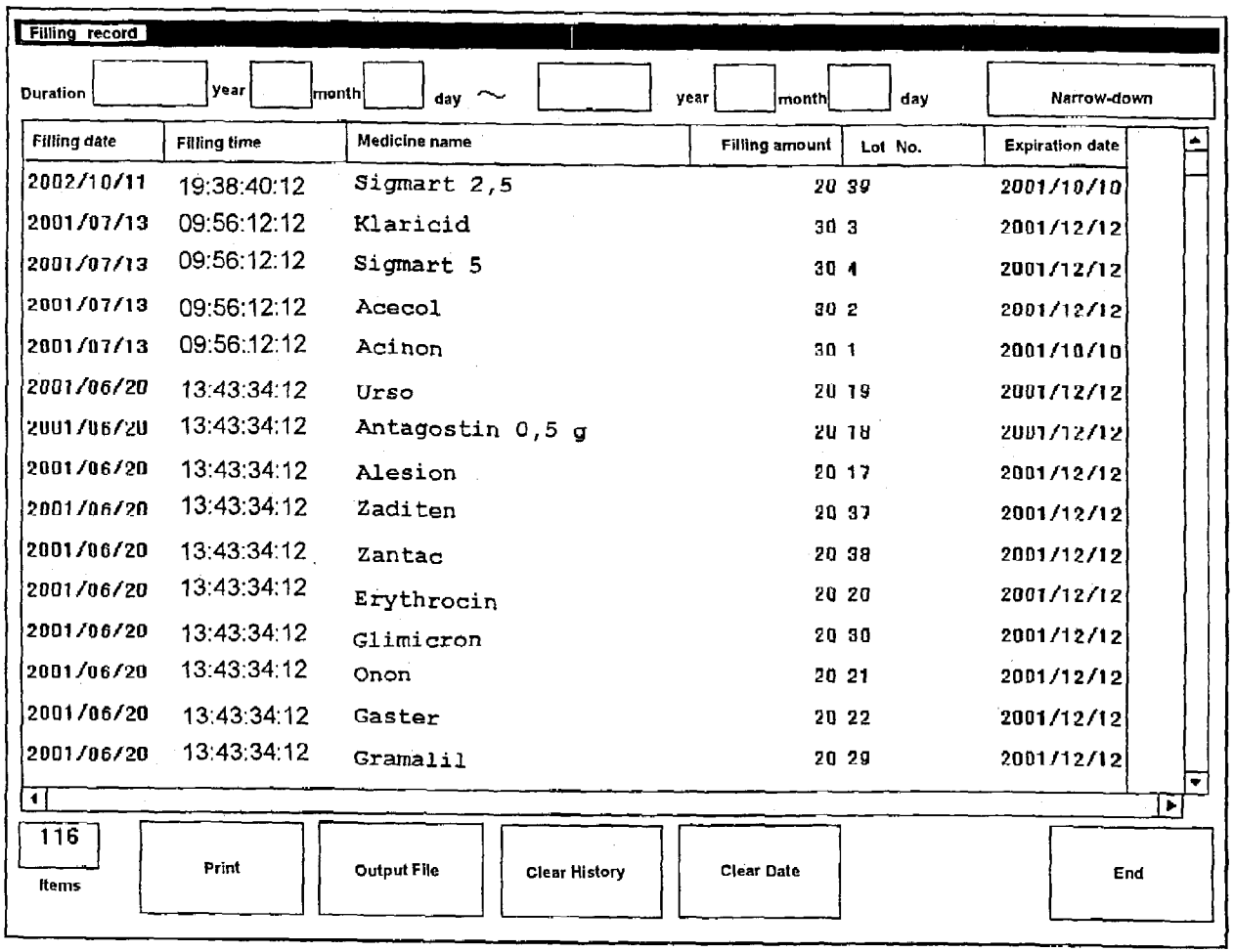
FIG. 27 is a view showing a form list.
Figure 28:
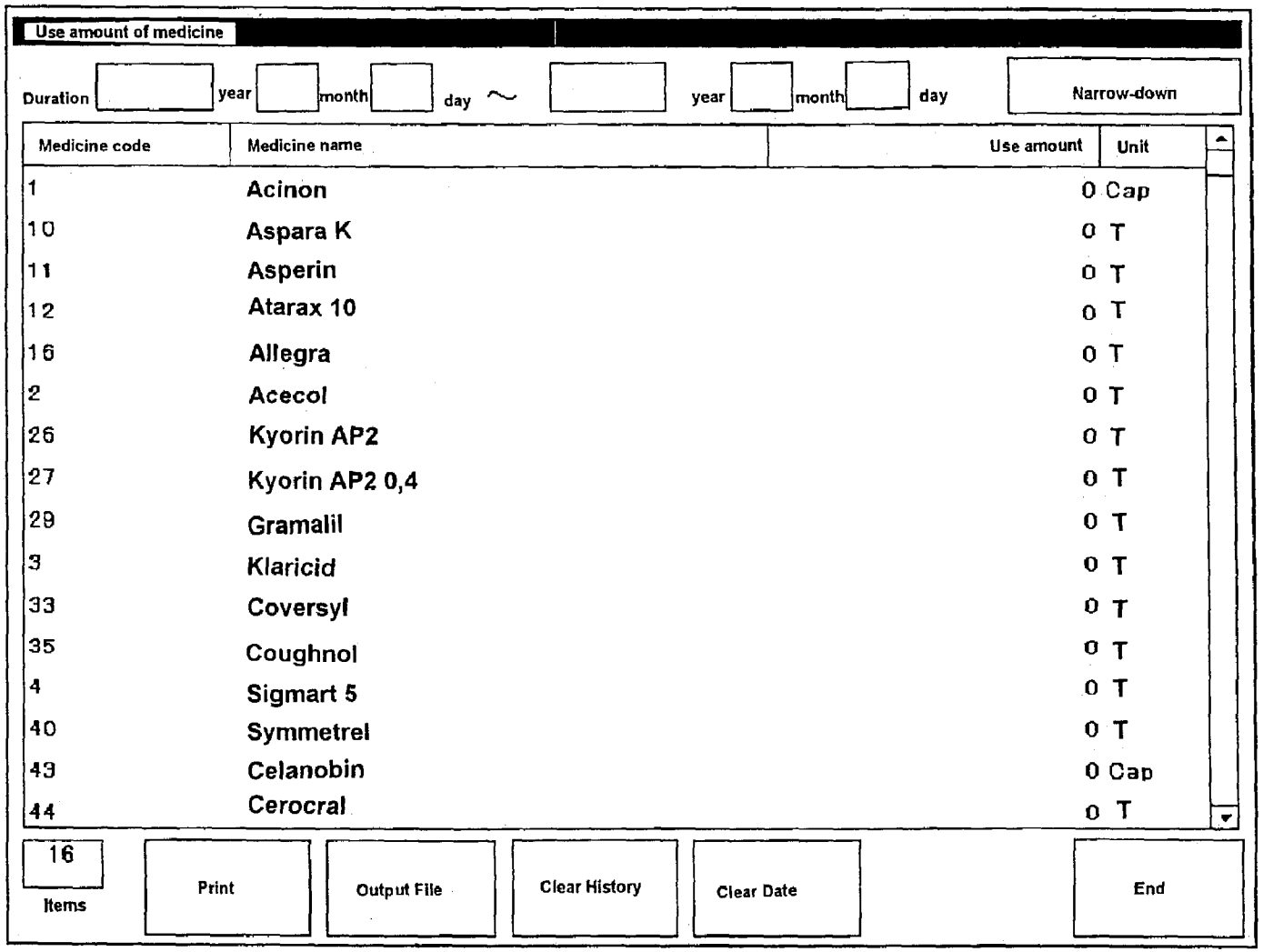
FIG. 28 is a view showing a form.

When the Filling/Statistics key is operated on the menu screen shown in FIG. 5, a selection screen shown, in FIG. 25 is displayed. The selection screen includes a Tablet Filling Work key, Filling Record Aggregation key and Medicine Use Amount Aggregation key. When the Tablet Filling Work key is operated, a filling work screen shown in FIG. 26 is displayed. The filling work screen is constituted by a list table of a shelf number, medicine code, medicine name, JAN code, stock amount, filling amount, upper limit of stock, proper stock amount, lot number and expiration date as well as various keys including a Filling key, Batch Filling key, Filling Amount Calculate key, Print key, All Medicine Display key and End key. When the Filling Record Aggregation key is operated, a form list shown in FIG. 27 is displayed. The form list is constituted by a pharmacist code, pharmacist name, filling date, filling time, medicine name, filling amount, lot number, expiration date and so forth. When the Medicine Use Amount Aggregation key is operated, a form shown in FIG. 28 is displayed. The processing is terminated by operating a Job End key.

Figure 29:
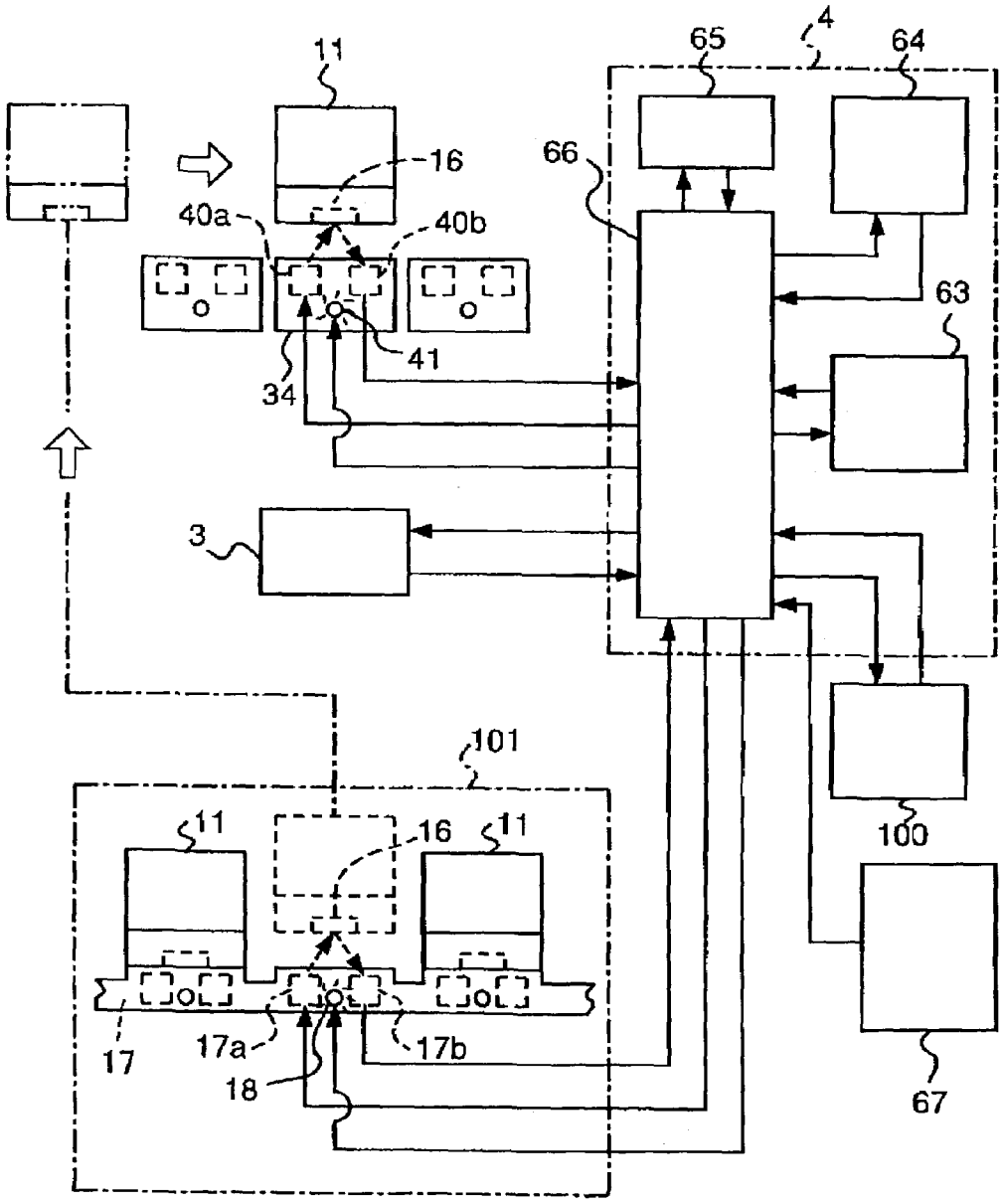
FIG. 29 is a block diagram showing a tablet processing operation.

The control unit 4 includes a storage site memory unit 63, a housing site memory unit 64, a proper housing site memory unit 65 and a central processing unit (CPU) 66 as shown in FIGS. 29 and 30.

The storage site memory unit 63 stores a storage site of a tablet cartridge 11 in the tablet storage rack 1 (FIG. 29).

The housing site memory unit 64 stores whether any of the tablet cartridges 11 is mounted on a tablet feeder 34.

The tablet has attribute such as easiness of jumping when dropped, easiness of sliding on a tilted surface, easiness of rolling and so forth. Therefore, time from a housing position to a packing position differs depending on the attribute of the tablet, which affects a packing speed. Therefore, in this embodiment, a proper housing site (vertical directions) is set beforehand depending on attributes of each tablet and stored in the proper housing site memory unit 65.

The central processing unit (CPU) 66 manages a storage site and a housing site of a tablet cartridge 11 and controls drives of the tablet feeder 34, packing device 3 and so forth.

Operations of the medicine packing apparatus are described below. However, in the following explanation, only display contents in the display unit 3, which characterize the present invention, are mentioned.

First, a master maintenance screen (FIGS. 14–23) is opened by operating the Setup key on the initial menu screen (FIG. 5), and required data such as patient data, dosage regimen and ward is registered beforehand. When data is new data such as a patient and a medicine, registration on the master maintenance screen (FIGS. 14–23) is required.

(New Input Processing)

When prescription data is inputted based on prescription of a patient, the Job Start key is operated on the initial menu screen (FIG. 5) to change the screen to the packing monitor screen (FIG. 6).

When the prescription data is unregistered, the Input key is operated to change the screen to the prescription input screen (FIG. 7). On the prescription input screen (FIG. 7), first, in the patient ID column, relevant data is selected from patient data registered on the master maintenance screen (FIGS. 14–23), and a department, ward name and dosage regimen are successively inputted. Then, a medicine code and a medicine name are selected in the medicine column, and a dose and taking time are inputted. At this time, since the taking time is decided by selecting the dosage regimen, no other taking time can be inputted. Therefore, an incorrect input can be reliably avoided.

Furthermore, when the Cassette Select key is operated to change the screen to the arrangement screen (FIG. 8) instead of directly inputting the dose and medicine taking time in the medicine column, dosage data can be inputted while grasping which medicine is contained in a tablet cartridge 11 arranged at which position. Therefore, a problem that a relevant medicine is not set when actual packing is started can be prevented. In this case, due to the selected dosage regimen, taking time (schedule) that can be inputted on the medicine number input screen (FIG. 9) is also restricted as with the medicine column.

Thus, when input of predetermined data is completed on the prescription input screen (FIG. 7), the Issue key, Interrupt key, Image key, Line Insert key, Line Delete key and Batch Register key can be operated. When the Issue key is operated, the screen is changed to the packing monitor screen (FIG. 6), patient data inputted in the data display column is displayed, and dosage data is displayed in the prescription data display frame at the upper right of the screen. When the Interrupt key is operated, data of another patient can be inputted by priority. When the Image key is operated, a print image to be printed on a medicine package is displayed. A prescribed medicine can be added by operating the Line Insert key, and the inputted medicine can be deleted by operating the Line Delete key. Furthermore, data inputted in the medicine column can be registered by operating the Batch Register key.

(Reuse of Input Data)

When prescription data registered in the past can be reused, that is, when contents of a prescription are the same, a DO key is operated on the monitor screen (FIG. 6) to change the screen to a DO screen (FIG. 13). Since previously prescribed registration data is displayed in a list on the DO screen (FIG. 13), relevant data is selected by using the Narrow-Down key, Search key or the like. Each time data is selected, the Issue key is operated, and the Back key is operated to change the screen to the packing monitor screen (FIG. 6), all the selected data is displayed in a list in the data display column. Furthermore, when the data needs to be changed, it is sufficient that the Select key is operated to display the prescription input screen (FIG. 7), and that the data is similarly inputted. Thus, by reusing registered prescribed data, new input of data can be saved, and hence work efficiency can be significantly improved.

When the prescription data is inputted as described above, a region corresponding to a medicine container containing a medicine to be fed is highlighted on the arrangement screen (FIG. 8). Therefore, a problem that an unpacked medicine is dismounted or removed by mistake can be prevented.

Figure 31:
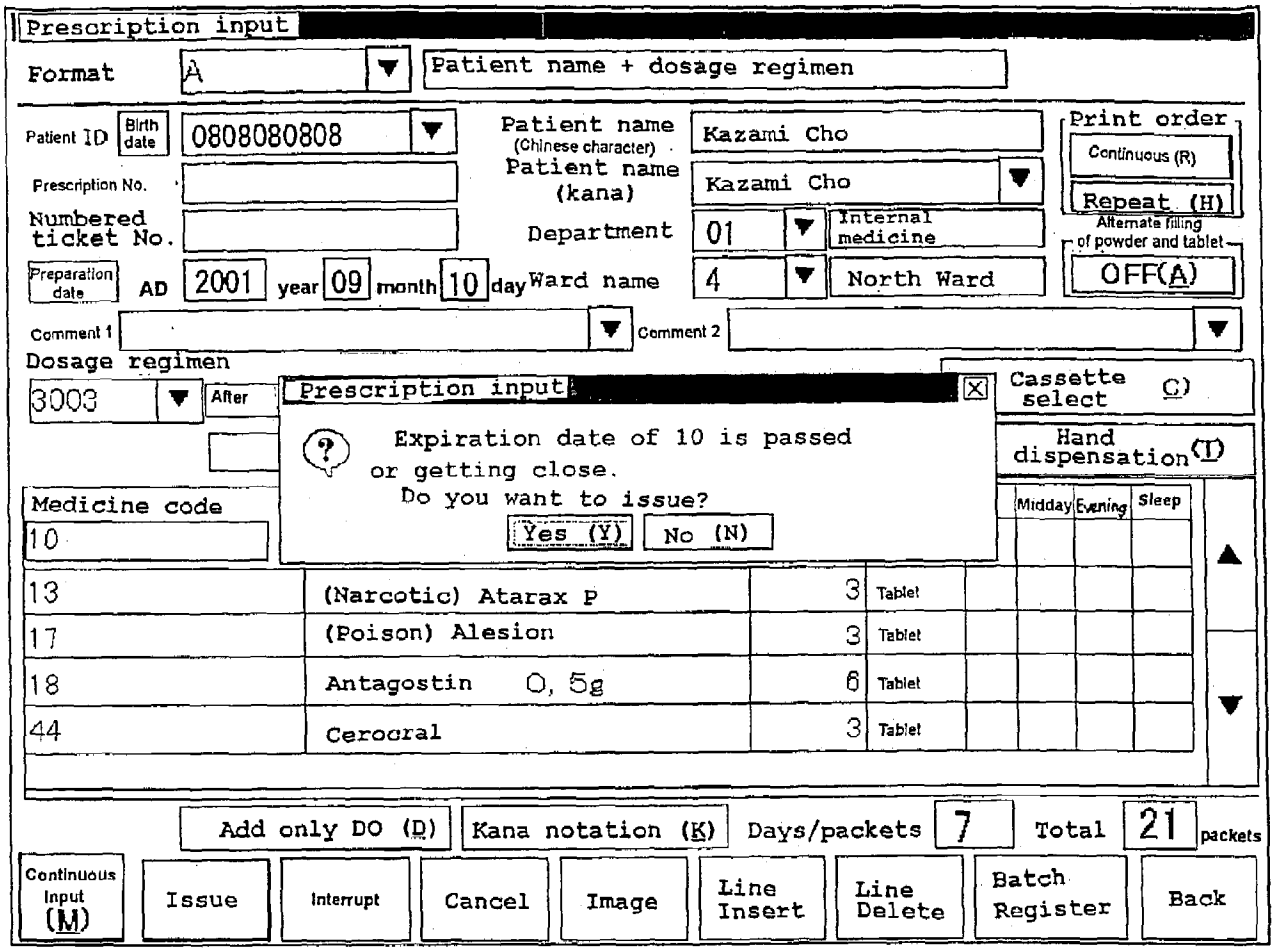
FIG. 31 is a view showing a state in which a warning is displayed on the packing monitor screen shown in FIG. 6.

Furthermore, for a medicine of which the expiration date is getting close or passed, a warning to the effect that expiration date is passed or is getting close is displayed on the prescription input screen as shown in FIG. 31. Consequently, a problem of prescribing a medicine of which expiration date is getting close or passed is prevented.

In this embodiment, a medicine that is not yet mounted on the tablet housing rack 1 is not mentioned, but a storage rack 101 may be disposed adjacent to the tablet housing rack 1.

In each storage site in the storage rack 101, a reader 17 is embedded and a display lamp 18 is installed so that the site can be viewed from the front. The reader 17 is constituted by a plurality of units each formed by integrating a light-emitting device 17*a* and a light-receiving device 17*b* . When a tablet cartridge 11 is mounted on a storage site, tablet data is read by reflecting light emitted from the light-emitting device 17*a* on the reflecting plate of the medicine identification unit 16 of the tablet cartridge 11 and receiving the light by the light-receiving 17*b*.

When such a storage rack is included, on the arrangement screen (FIG. 8) displayed in the display unit 4, it is preferable in that replacement can be efficiently performed to highlight regions corresponding to medicine containers for feeding medicines included in all prescription data and to display that other medicine containers can be replaced successively from a region closer to the storage rack among other regions.

Furthermore, in this embodiment, only a tablet cartridge 11 positioned in the-free region in the lowermost stage can be replaced by clicking the Temporary Alteration key on the arrangement screen shown in FIG. 8, but all medicine containers may be replaced on the arrangement screen shown in FIG. 32. In FIG. 32, when a cell corresponding to a housing site requiring replacement of a medicine container is right-clicked, a displayed medicine name is highlighted, and can be directly changed by a keyboard or the like. However, by right-clicking the cell or the like, registered medicine names may pop up and a display in the cell may be changed to a medicine name selected therefrom.

Figure 33:
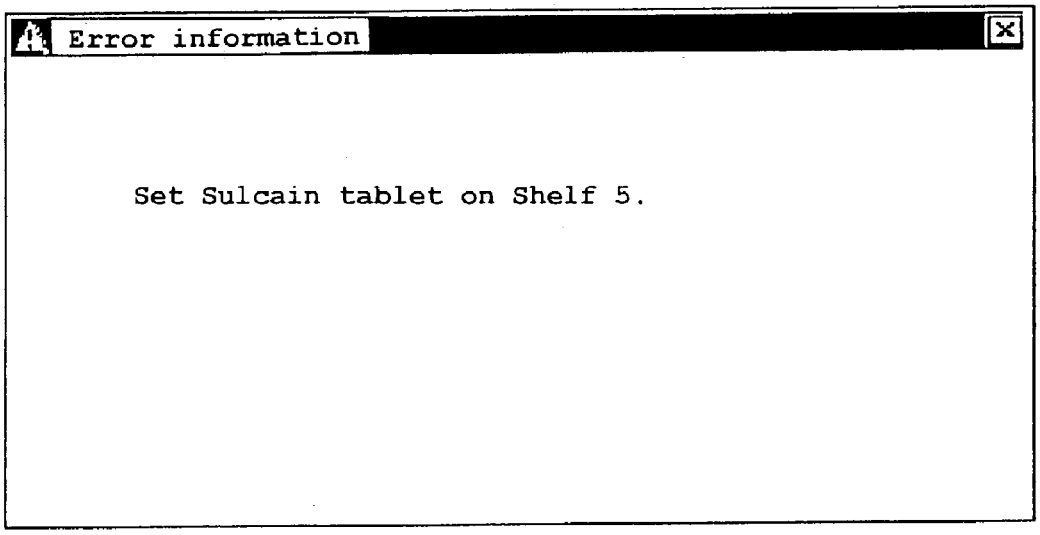
FIG. 33 is a view showing an error information screen that pops up on the arrangement screen in FIG. 32.
Figure 3:
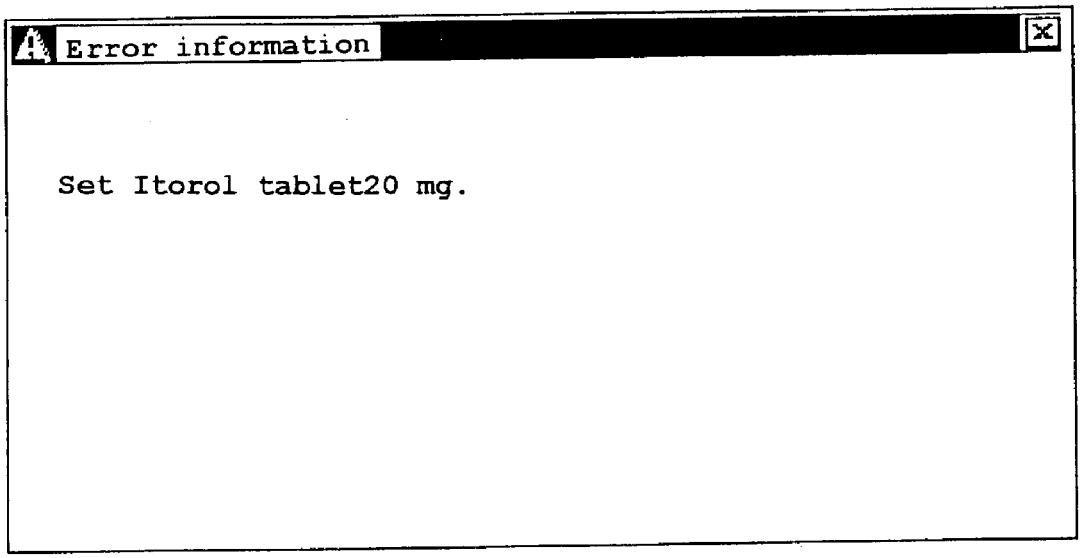

When a medicine container containing a medicine that is not the medicine name set on the arrangement screen (FIG. 32) is mounted, error information shown in FIG. 33 pops up. Whether the mounted medicine container is correct or not is judged by whether a registered identification code and an identification code of the medicine container read by the reader 17 match. Furthermore, the display lamp 18 at a relevant housing site in the medicine housing rack 1 is blinked (furthermore, may be notified with a buzzer or the like). Consequently, incorrect mount of a medicine container is prevented. Furthermore, when a packing work is started and then a medicine container is dismounted from the medicine housing rack 1, the arrangement screen shown in FIG. 32 is displayed and a display of the relevant cell is distinguished. Furthermore, when a medicine contained in a medicine container that is not mounted is prescribed, a mounting instruction screen of a temporary medicine container shown in FIG. 34 pops up on the screen.

Furthermore, a tablet cartridge 11 is described as a medicine container in this embodiment, but other containers containing medicines such as a capsule can be similarly adopted.

As clear from the aforementioned explanation, according to the present invention, since an arrangement screen in which medicine names are assigned to a plurality of regions corresponding to arrangement of the medicine containers is displayed on the display means, desired medicine can be selected while confirming the actual arrangement state of the medicines. Therefore, easy checking of medicines and excellent operability can be expected and succeeding packing process can be smoothly conducted.

Although the present invention has been fully described by way of the examples with reference to the accompanying drawing, it is to be noted that various changes and modifications will be apparent to those skilled in the art. Therefore, unless such changes and modifications otherwise depart from the spirit and scope of the present invention, they should be construed as being included therein.

What is claimed is:

1. A medicine packing apparatus, comprising:

a medicine housing rack for housing a plurality of medicine containers, wherein each of the medicine containers is adapted to hold a medicine and is equipped with a medicine identification unit, medicine feeding means for feeding a medicine included in prescription data from one of the medicine containers, medicine packing means for packing the medicine fed from the medicine feeding means, reading means for reading medicine data from the medicine identification unit of the medicine container, housing site searching means for searching a housing site of the medicine container, memory means for storing the medicine data read by the reading means and the housing site searched by the housing site searching means, and display means for displaying an arrangement screen in which medicine names are assigned to a plurality of regions corresponding to arrangement of the medicine containers housed in the medicine housing rack based on the medicine data and the housing sites stored in the memory means.

2. The medicine packing apparatus according to claim 1, wherein, by operating a region in which a medicine name is displayed while the arrangement screen is being displayed in the display means, a medicine number input screen is displayed separately from the arrangement screen, and dosage regimen data including a medicine taking schedule and doses can be inputted by an operation on the medicine number input screen.

3. The medicine packing apparatus according to claim 1, wherein the memory means stores previously prescribed prescription data, and when prescription data of a patient is identical to prescription data stored in the memory means, the prescription data stored in the memory means can be reused.

4. The medicine packing apparatus according to claim 2, wherein taking time that is not included in the dosage regimen data cannot be inputted on the tablet number input screen displayed in the display means.

5. The medicine packing apparatus according to claim 1, wherein the housing searching means is operable to detect whether a medicine container is mounted on or dismounted from the medicine housing rack, and the display means is operable to display or deletes a medicine name in a region corresponding to the relevant medicine container.

6. The medicine packing apparatus according to claim 1, wherein, when a medicine container containing a relevant medicine cannot be detected by the housing site searching means, the display means is operable to display a screen with instructions for mounting the medicine container separately from the arrangement screen.

7. The medicine packing apparatus according to claim 1, wherein, when the medicine container is mounted on or absent from the medicine housing rack, the arrangement screen is displayed in the display means.

8. The medicine packing apparatus according to claim 1, wherein a warning can be displayed in the display means based on a medicine use expiration date calculated from medicine data stored in the memory means.

9. The medicine packing apparatus according to claim 1, wherein all regions corresponding to unpacked medicines included in prescription data are highlighted in the display means.

10. The medicine packing apparatus according to claim 1, wherein a substituted medicine container storage rack is included separately from the medicine housing rack, and substitutable sites of medicine containers housed in the medicine housing rack, except those including unpacked medicines included in prescription data, are displayed in the display means successively from the one closest to the substituted medicine container storage rack.

11. The medicine packing apparatus according to claim 1, wherein the medicine housing rack has a fixed region in which housing sites are set beforehand according to kinds of medicines contained in medicine containers, and when a medicine container containing a medicine that is not a medicine set beforehand at any housing site of the fixed region is mounted, an error indication is displayed in the display means.

12. The medicine packing apparatus according to claim 1, wherein when a medicine container is removed from the medicine housing rack during packing, the arrangement screen is displayed in the display means, and a medicine name displayed in a relevant region on the arrangement screen is not displayed.

13. The medicine packing apparatus according to claim 12, wherein, when a medicine being packed currently is contained in a medicine container the has been removed from the medicine housing rack, an error indication is displayed separately from the arrangement screen.

14. The medicine packing apparatus according to claim 1, wherein, when a housing site of a medicine container is changed, a housing site of the medicine container is researched by the housing site searching means and a searching result is re-displayed as an arrangement screen in the display means.

15. The medicine packing apparatus according to claim 1, wherein the arrangement screen displayed in the display means is a setup screen for setting a medicine container that can be mounted on each housing site in the medicine housing rack.

* * * * *

UNITED STATES PATENT AND TRADEMARK OFFICE

CERTIFICATE OF CORRECTION

PATENT NO. : 7,040,077 B2
APPLICATION NO. : 10/252413
DATED : May 9, 2006
INVENTOR(S) : Keita Yasuoka et al.

It is certified that error appears in the above-identified patent and that said Letters Patent is hereby corrected as shown below:

IN THE CLAIMS

Column 13, Line 28, Claim 4, line 2, change "time" to --wherein a medicine taking schedule--.
Column 13, Line 33, Claim 5, line 3, change "dismounted" to --removed--.

IN THE SPECIFICATION

Column 1,
line 49, change"constitution," to --arrangement,--.
line 50, change "grasped at one" to --determined at a single--.
line 53, insert --an-- before "incorrect".
Column 2,
line 4, change "that" to --indicating that the medicine--.
line 10, insert --(removed)-- before "from".
line 21, change "grasped" to --determined--.
Column 3,
line 60, delete "that".
Column 5,
line 7, change "constitution" to --construction--.
line 13, change "existence of the" to --the existence of--
line 14, change "exists" to --is present--.
line 21, change "unit 4" to --unit 5--.
line 31, change "constitution that" to --arrangement in which--.
Column 6,
line 59, change "dismounted," to --removed,--.
Column 7,
line 13, insert --medicine-- before "taking".
line 36, insert --a medicine-- before "taking".
line 61, change "popup" to --pop-up--.
Column 10,
line 14, change "unit 4" to --unit 5--.
line 19, change "rack 1" to --rack 101--.
line 22, change "attribute" to --attributes--.
line 25, change "attribute" to --attributes--.
line 26, change "a" to --the--.
line 35, change "unit 3" to --unit 4--.
line 66, change "a" to --the--.

UNITED STATES PATENT AND TRADEMARK OFFICE

CERTIFICATE OF CORRECTION

PATENT NO. : 7,040,077 B2
APPLICATION NO. : 10/252413
DATED : May 9, 2006
INVENTOR(S) : Keita Yasuoka et al.

It is certified that error appears in the above-identified patent and that said Letters Patent is hereby corrected as shown below:

IN THE SPECIFICATION

Column 11,
line 5, insert --the--before "input".
line 37, insert --a-- before "new".
line 45, insert --has-- before "passed"
line 46 and 49, insert --the-- before "expiration".
line 46, change "is passed" to --has passed--.

Column 12,
line 25, insert --an-- before "incorrect", and change "mount" to --mounting--.
line 26, change "started" to --started,--.
line 38, insert --is-- before "clear".
line 41, insert --the-- before "arrangement".
line 45, insert --the-- before "succeeding".
line 49, change "drawing" to --drawings--.

Signed and Sealed this

Seventh Day of November, 2006

JON W. DUDAS
*Director of the United States Patent and Trademark Office*